US008987946B2

(12) United States Patent
Higashiyama et al.

(10) Patent No.: US 8,987,946 B2
(45) Date of Patent: Mar. 24, 2015

(54) AIR CONDITIONER

(71) Applicant: Daikin Industries, Ltd., Osaka-shi, Osaka (JP)

(72) Inventors: Shin Higashiyama, Osaka (JP); Hiroshi Doumae, Osaka (JP); Motonobu Ikeda, Osaka (JP); Shinya Ohtsuki, Osaka (JP); Masaki Okauchi, Osaka (JP); Shunichi Uenaka, Osaka (JP); Mario Hayashi, Osaka (JP); Shingo Ohnishi, Osaka (JP)

(73) Assignee: Daikin Industries, Ltd., Osaka-Shi (JP)

( * ) Notice: Subject to any disclaimer, the term of this patent is extended or adjusted under 35 U.S.C. 154(b) by 0 days.

(21) Appl. No.: 14/369,333

(22) PCT Filed: Dec. 27, 2012

(86) PCT No.: PCT/JP2012/008415

§ 371 (c)(1),
(2) Date: Jun. 27, 2014

(87) PCT Pub. No.: WO2013/099277

PCT Pub. Date: Jul. 4, 2013

(65) Prior Publication Data

US 2015/0001962 A1 Jan. 1, 2015

(30) Foreign Application Priority Data

Dec. 28, 2011 (JP) ..... 2011-287104
Dec. 28, 2011 (JP) ..... 2011-289602

(51) Int. Cl.
*H01H 47/00* (2006.01)
*F24F 11/02* (2006.01)

(52) U.S. Cl.
CPC ..... *F24F 11/02* (2013.01)
USPC ..... 307/113

(58) Field of Classification Search
USPC ..... 307/113
See application file for complete search history.

(56) References Cited

U.S. PATENT DOCUMENTS

2007/0251250 A1 11/2007 Meakawa
2008/0092570 A1 4/2008 Choi

FOREIGN PATENT DOCUMENTS

EP 2241831 A1 10/2010
JP 6-66447 A 3/1994
JP 2000-74463 A 3/2000
JP 2006-84060 A 3/2006
JP 2008-101895 A 5/2008
JP 2010-54065 A 3/2010
JP 2010-243051 A 10/2010

OTHER PUBLICATIONS

International Search Report, issued in PCT/JP2012/008415, dated Mar. 12, 2013.

*Primary Examiner* — Rexford Barnie
*Assistant Examiner* — Dru Parries
(74) *Attorney, Agent, or Firm* — Birch, Stewart, Kolasch & Birch, LLP

(57) ABSTRACT

In an air conditioner, an auxiliary circuit configured to prevent a current flow in a power supply wiring in an operation stop period and to determine whether to adapt an outdoor unit to a unit that is able to transition to a standby mode, is provided on the power supply wiring.

11 Claims, 20 Drawing Sheets

AIR CONDITIONER

TECHNICAL FIELD

The present invention relates to air conditioners, and particularly to a technique for reducing standby power consumption of air conditioners.

BACKGROUND ART

As described in Patent Document 1, in some type of air conditioners, power supply to a circuit in an outdoor unit is stopped during standby so that the outdoor unit transitions to a standby mode in order to reduce standby power consumption, and the outdoor unit is supplied with power from an indoor unit at start-up so that the outdoor unit is recovered from the standby mode to be is started.

CITATION LIST

Patent Document

[Patent Document 1] Japanese Unexamined Patent Publication No. 2010-243051

SUMMARY OF THE INVENTION

Technical Problem

Conventional air conditioners, however, are not designed in consideration of employing a combination of an outdoor unit that can transition to a standby mode and an indoor unit that cannot transition to a standby mode. Specifically, if an indoor unit cannot transition to a standby mode, i.e., is a unit not configured to reduce standby power consumption (hereinafter referred to as a standby power reduction unsupporting model), an outdoor unit cannot be started from a standby mode, and no smooth operation of the air conditioner cannot be obtained.

It is therefore an object of the present invention to enhance reliability with smooth operation of a system even in the presence of a standby power reduction unsupporting model that cannot transition to a standby mode.

Solution to the Problem

A first aspect of the present invention is directed to an air conditioner including an outdoor unit (10) and an indoor unit (20) that receive electric power from a main power supply line (1L), and the air conditioner is configured to transition to a standby mode in which no electric power is supplied to the outdoor unit (10) in an operation stop period. In the first aspect, the outdoor unit (10) is configured to transition to a standby mode and to be connectable to an indoor unit (20) that is configured to transition to a standby mode and an indoor unit (20) that is not configured to transition to the standby mode. The air conditioner also includes: an outdoor control circuit (13) provided in the outdoor unit (10), and configured to receive electric power from the main power supply line (1L) through a power supply wiring (1*a*); and a selection mechanism (16) provided on the power supply wiring (1*a*), and configured to prevent a current flow in the power supply wiring (1*a*) in the operation stop period to determine whether to adapt the outdoor unit (10) to a unit that is able to transition to a standby mode.

In the first aspect, if the indoor unit (20) is a unit that can reduce standby power consumption (hereinafter referred to as a standby power reduction supporting model), the selection mechanism (16) adapts the outdoor unit (10) to a unit that is able to transition to a standby mode in which no electric power is supplied to the outdoor unit (10) in the operation stop period. On the other hand, if the indoor unit (20) is a standby power reduction unsupporting model, the selection mechanism (16) adapts the outdoor unit (10) to a unit that is not able to transition to the standby mode in the operation stop period. The selection by the selection mechanism (16) enables smooth operation in, for example, starting the outdoor unit (10).

In a second aspect of the present invention, in the air conditioner of the first aspect, the selection mechanism (16) includes: a switch (K13R) provided in the power supply wiring (1*a*), and configured to prevent a current flow in the power supply wiring (1*a*) in the operation stop period so that the air conditioner transitions to the standby mode in which no electric power is supplied to the outdoor unit (10); an auxiliary circuit (16*a*) connected to the power supply wiring (1*a*), provided in parallel with the switch (K13R), and configured to always supply electric power to the outdoor control circuit (13); and an opening/closing unit (17) provided in the auxiliary circuit (16*a*) and configured to open and close the auxiliary circuit (16*a*).

In the second aspect, if the indoor unit (20) is a standby power reduction supporting model, the opening/closing unit (17) prevents a current flow in the auxiliary circuit (16*a*), and the switch (K13R) causes the outdoor unit (10) to transition to the standby mode in which no electric power is supplied to the outdoor unit (10) in the operation stop period. On the other hand, if the indoor unit (20) is a standby power reduction unsupporting model, the opening/closing unit (17) allows a current to flow in the auxiliary circuit (16*a*), and prevents the outdoor unit (10) from transitioning to the standby mode in the operation stop period, irrespective of operation of the switch (K13R). The opening/closing operation of the opening/closing unit (17) enables smooth operation in, for example, starting the outdoor unit (10).

In a third aspect of the present invention, the opening/closing unit (17) is a connector that causes current to flow in the auxiliary circuit (16*a*).

In the third aspect, if the indoor unit (20) is a standby power reduction supporting model, a connection pin is removed from the connector so that the auxiliary circuit (16*a*) turns off. On the other hand, if the indoor unit (20) is a standby power reduction unsupporting model, the connection pin remains in the connector so that the auxiliary circuit (16*a*) turns on.

In a fourth aspect of the present invention, in the air conditioner of the second aspect, the opening/closing unit (17) is a latching relay that turns on the auxiliary circuit (16*a*).

In the fourth aspect, if the indoor unit (20) is a standby power reduction supporting model, the latching relay turns off the auxiliary circuit (16*a*). On the other hand, if the indoor unit (20) is a standby power reduction unsupporting model, the latching relay turns on the auxiliary circuit (16*a*).

In a fifth aspect of the present invention, in the air conditioner of the first aspect, the selection mechanism (16) is a latching relay provided in the power supply wiring (1*a*) and configured to open and close the power supply wiring (1*a*) and to prevent a current flow in the power supply wiring (1*a*) in the operation stop period so that the air conditioner transitions to the standby mode in which no electric power is supplied to the outdoor unit (10).

In the fifth aspect, if the indoor unit (20) is a standby power reduction supporting model, the latching relay opens and closes the power supply wiring (1*a*). In an operation period, a current is allowed to flow in the power supply wiring (1*a*), whereas in the operation stop period, a current flow is stopped in the power supply wiring (1*a*) so that the outdoor unit (10) transitions to the standby mode in which no electric power is supplied to the outdoor unit (10). On the other hand, if the indoor unit (20) is a standby power reduction unsupporting model, the latching relay always allows a current to flow in the power supply wiring (1*a*) so that the outdoor unit (10) does not transition to the standby mode in the operation stop period.

In a sixth aspect of the present, in the air conditioner of the first aspect, the selection mechanism (16) includes: a switch (K13R) provided in the power supply wiring (1*a*), and configured to prevent a current flow in the power supply wiring (1*a*) in the operation stop period so that the air conditioner transitions to the standby mode in which no electric power is supplied to the outdoor unit (10); an auxiliary circuit (51) including first and second short-circuit lines (51*a*, 51*b*) that are separated from each other, are connected to the power supply wiring (1*a*), and bypasses the switch (K13R); a connector (52*a*) capable of connecting the first short-circuit line (51*a*) and the second short-circuit line (51*b*) to each other; a short-circuit detector (53) configured to detect connection between the first short-circuit line (51*a*) and the second short-circuit line (51*b*); and a failure detector (23) configured to determine whether the air conditioner is configured to be able to transition to the standby mode or not based on at least device model specification information on the indoor unit (20), and to detect a connection failure in the auxiliary circuit (51) when the short-circuit detector (53) detects connection between the first short-circuit line (51*a*) and the second short-circuit line (51*b*) if it is determined that the air conditioner is configured to be able to transition to the standby mode.

In the sixth aspect, in a situation where the connector plug is removed from the connector (52*a*) and the short-circuit lines (51*a*, 51*b*) of the auxiliary circuit (51) are not connected to each other, for example, the outdoor unit (10) is switched, by opening and closing the switch (K13R), to a state in which electric power is supplied to the outdoor unit (10) and the standby mode in which no electric power is supplied to the outdoor unit (10).

On the other hand, when the short-circuit lines (51*a*, 51*b*) of the auxiliary circuit (51) are connected to each other by the connector (52*a*), a path extending from the AC power supply (40) to the outdoor control circuit (13) while bypassing the switch (K13R) is formed. Thus, even while the switch (K13R) prevents a current from flowing in the power supply wiring (1*a*), electric power is always supplied from the AC power supply (40) to the outdoor control circuit (13) through the auxiliary circuit (51). Accordingly, even while the indoor unit (20) that is a standby power reduction unsupporting model is connected to the outdoor unit (10) that is a standby power reduction supporting model, the outdoor unit (10) is forcedly started. That is, in the sixth aspect, the auxiliary circuit (51) and the connector (52*a*) constitute a forced start-up mechanism.

In addition, the failure detector (23) determines whether the outdoor unit (10) is to transition to the standby mode or not. For example, in the presence of a combination of the indoor unit (20) that is a standby power reduction unsupporting model and the outdoor unit (10) that is a standby power reduction supporting model, it is determined that the air conditioner cannot transition to the standby mode. On the other hand, if it is determined that the air conditioner can transition to the standby mode, detection of connection between the short-circuit lines (51*a*, 51*b*) by the short-circuit detector (53) causes the failure detector (23) to detect a connection failure in the auxiliary circuit (51).

That is, since forced start-up setting of the forced start-up mechanism is based on determination by an installation operator of the air conditioner in the field, this setting might include an error in some cases. If the forced start-up setting is incorrect in using a combination of the outdoor unit (10) that is a standby power reduction supporting model and the indoor unit (20) that is a standby power reduction supporting model, shutting off of a power supply to the outdoor unit (10) fails regardless of the ability of the air conditioner that can shut off a power supply to the outdoor unit (10).

In view of this, in the sixth aspect, if the short-circuit detector (53) detects connection between the short-circuit lines (51*a*, 51*b*), the failure detector (23) detects a connection failure in the auxiliary circuit (51).

In a seventh aspect of the present invention, in the air conditioner of the sixth aspect, the short-circuit detector (53) includes a terminal connected to ground (GND), an external power supply terminal (53*a*) that receives an external power supply, a detector (53*b*) that is connected to the external power supply terminal (53*a*) and detects a supply voltage from the external power supply terminal (53*a*), and the connector (52*a*) configured to connect the first short-circuit line (51*a*) and the second short-circuit line (51*b*) to each other and to connect the ground (GND) and the external power supply terminal (53*a*) to each other.

In the seventh aspect, the ground (GND) and the external power supply terminal (53*a*) are disconnected from each other when the connector (52*a*) disconnects the short-circuit lines (51*a*, 51*b*) from each other, whereas the ground (GND) and the external power supply terminal (53*a*) are connected to each other when the connector (52*a*) connects the short-circuit lines (51*a*, 51*b*). Thus, the detector (53*b*) receives a high voltage when the connector (52*a*) disconnects the short-circuit lines (51*a*, 51*b*) from each other, and receives a low voltage when the connector (52*a*) connects the short-circuit lines (51*a*, 51*b*) to each other.

In an eighth aspect of the present invention, in the air conditioner of the sixth aspect, the short-circuit detector (53) includes ground (GND), an external power supply terminal (53*a*) that receives an external power supply, a detector (53*b*) that is connected to the external power supply terminal (53*a*) and detects a supply voltage supplied from the external power supply terminal (53*a*), a light emitting diode (53*d*) that emits light when the first short-circuit line (51*a*) and the second short-circuit line (51*b*) are connected to each other, and a phototransistor (53*e*) connected between the external power supply terminal (53*a*) and the ground (GND) and configured to operate in response to light from the light emitting diode (53*d*).

In the eighth aspect, the light emitting diode (53*d*) and the phototransistor (53*e*) constitute a photocoupler. When the connector (52*a*) disconnects the short-circuit lines (51*a*, 51*b*) from each other, the light emitting diode (53*d*) does not emit light, and the phototransistor (53*e*) does not operate. Thus, the ground (GND) and the external power supply terminal (53*a*) are not substantially electrically connected to each other. On the other hand, when the connector (52*a*) connects the short-circuit lines (51*a*, 51*b*) to each other, the light emitting diode (53*d*) emits light, and the phototransistor (53*e*) operates. Thus, the ground (GND) and the external power supply terminal (53*a*) are electrically connected to each other. Accordingly, in a manner similar to the seventh aspect, the detector (53*b*) receives a high voltage when the connector (52*a*) disconnects the short-circuit lines (51*a*, 51*b*) from each other, and receives a low voltage when the connector (52*a*) connects the short-circuit lines (51*a*, 51*b*) each other.

In a ninth aspect of the present invention, the air conditioner of any one of the sixth to eighth aspects further includes: a remote controller (30); and a notification unit (23) that notifies the remote controller (30) of a connection failure in the auxiliary circuit (51) when the failure detector (23) detects the connection failure.

In the ninth aspect, when the failure detector (23) detects a connection failure in the auxiliary circuit (51), the notification unit (23) notifies the remote controller (30) of the connection failure in the auxiliary circuit (51).

Advantages of the Invention

In the first aspect, the selection mechanism (16) determines whether to adapt the outdoor unit (10) to a unit that is able to transition to a standby mode in which no electric power is supplied to the outdoor unit (10) in the operation stop period. Thus, if the air conditioner includes a standby power reduction unsupporting model that cannot transition to the standby mode, transition of the outdoor unit (10) to the standby mode can be inhibited. As a result, even in the presence of the standby power reduction unsupporting model, the reliability can be enhanced with smooth operation.

In the second aspect, whether to adapt the outdoor unit (10) to a unit that is able to transition to the standby mode or not is selected by opening or closing the auxiliary circuit (16*a*). Thus, it is ensured that the outdoor unit (10) is adapted to the standby power reduction unsupporting model, irrespective of operation of the switch (K13R) of the power supply wiring (1*a*).

In the third aspect, since the opening/closing unit (17) is the connector, it is ensured that the outdoor unit (10) is adapted to the standby power reduction unsupporting model with a simple configuration.

In the fourth aspect, since the opening/closing unit (17) is the latching relay, the opening/closing unit (17) automatically opens and closes, thereby enhancing operability.

In the fifth aspect, since the switch (K13R) of the power supply wiring (1*a*) is the latching relay, one latching relay can perform both control of transition to the standby mode and adapting the outdoor unit (10) to the standby power reduction unsupporting model. As a result, the configuration can be simplified.

In the sixth aspect, in the air conditioner that can transition to the standby mode, when the short-circuit lines (51*a*, 51*b*) of the auxiliary circuit (51) are connected to each other by the connector (52*a*), the failure detector (23) can detect a connection failure in the auxiliary circuit (51). Thus, the installation operator can find an erroneous connection between the short-circuit lines (51*a*, 51*b*) of the auxiliary circuit (51). In this manner, the installation operator can disconnect the short-circuit lines (51*a*, 51*b*). Accordingly, it is possible to avoid a failure in shutting off a power supply to the outdoor unit (10) when a user uses an air conditioner that can transition to the standby mode. Thus, the reliability can be enhanced with smooth operation of the air conditioner.

In the seventh aspect, upon application of a low voltage, the detector (53*b*) can detect connection between the short-circuit lines (51*a*, 51*b*) of the auxiliary circuit (51).

In addition, since the short-circuit detector (53) uses the connector (52*a*) connecting the short-circuit lines (51*a*, 51*b*) to each other, it is possible to detect connection between the short-circuit lines (51*a*, 51*b*) with a simple configuration with a reduced number of components.

In the eighth aspect, in a manner similar to the seventh aspect, upon application of a low voltage, the detector (53*b*) can detect connection between the short-circuit lines (51*a*, 51*b*) of the auxiliary circuit (51).

In the ninth aspect, in a situation where the failure detector (23) detects a connection failure in the auxiliary circuit (51), the notification unit (23) notifies the remote controller (30) of the connection failure in the auxiliary circuit (51). Thus, the installation operator can find erroneous connection between the short-circuit lines (51*a*, 51*b*) of the auxiliary circuit (51) without fail, and can disconnect the short-circuit lines (51*a*, 51*b*). Thus, it is further ensured to avoid a failure in shutting off a power supply to the outdoor unit (10) when a user uses an air conditioner that can transition to the standby mode, thereby enhancing the reliability.

DESCRIPTION OF EMBODIMENTS

Embodiments of the present invention will be described with reference to the drawings. Note that the following description of the preferred embodiments is merely illustrative in nature, and is not intended to limit the scope, applications, and use of the invention.

<First Embodiment>

<Overall Configuration>

Figure 1:
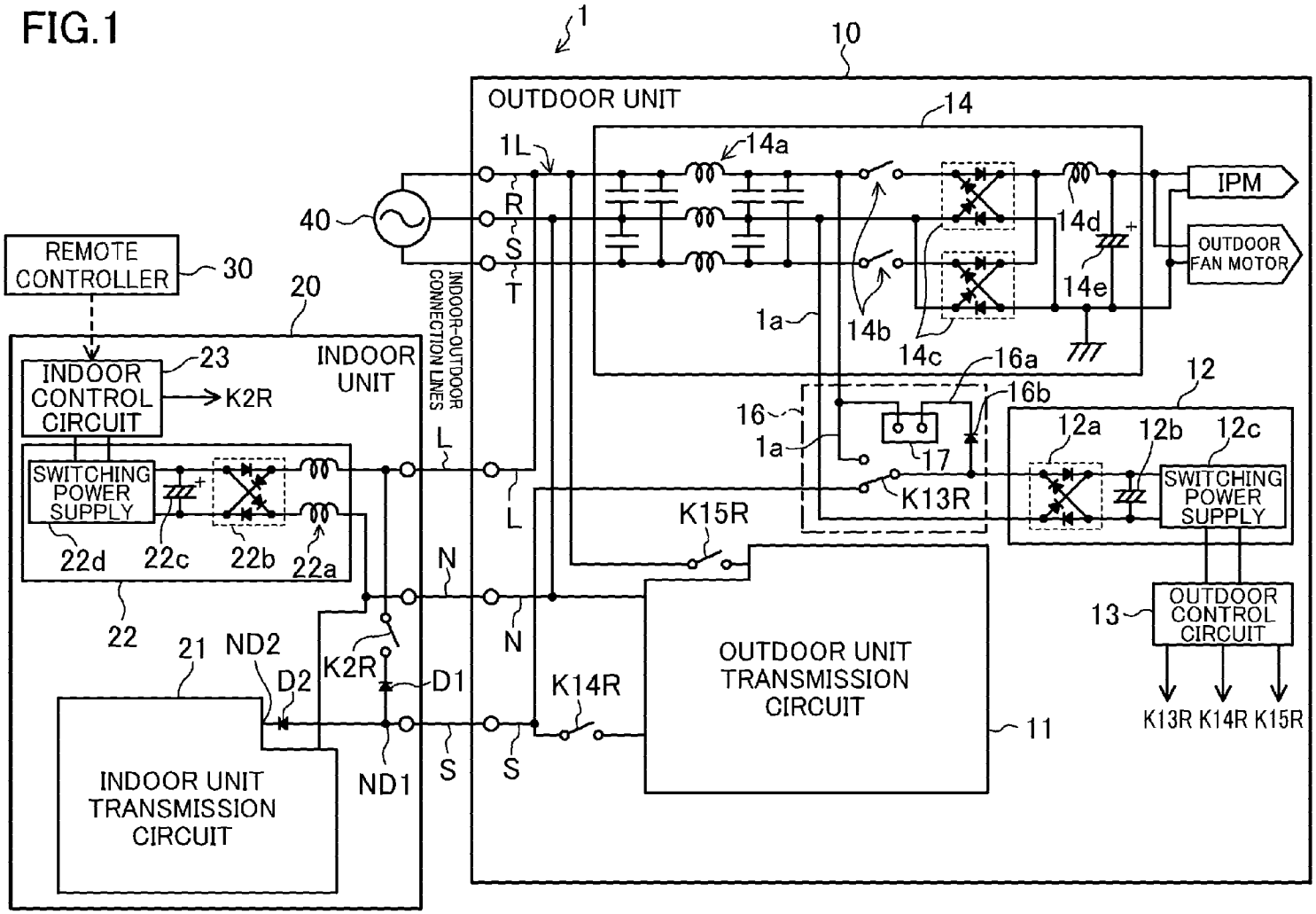
FIG. 1 is a block diagram illustrating an electrical system of an air conditioner according to a first embodiment of the present invention.

FIG. 1 is a block diagram illustrating an electrical system of an air conditioner (1) according to a first embodiment of the present invention. As illustrated in FIG. 1, the air conditioner (1) includes an outdoor unit (10), an indoor unit (20), and a remote control unit (30). Although not shown, the outdoor unit (10) includes an electric compressor, an outdoor heat exchanger, an outdoor fan, and an expansion valve, for example. The indoor unit (20) includes an indoor heat exchanger and an indoor fan, for example. In the air conditioner (1), these components constitute a refrigerant circuit (not shown) that performs a refrigeration cycle.

In the air conditioner (1), the outdoor unit (10) receives an AC (a three-phase AC at 200 V in this example) from a commercial AC power supply (40) and uses the AC as electric power for circuits and the electric compressor in the outdoor unit (10). The outdoor unit (10) also supplies part of the three-phase AC corresponding to two phases to the indoor unit (20). Signal communication is performed between the outdoor unit (10) and the indoor unit (20) in order to control the outdoor unit (10) from the indoor unit (20). For this purpose, the air conditioner (1) includes, between the outdoor unit (10) and the indoor unit (20), three lines (indoor-outdoor communication lines): a power line (L) for transmitting AC power from the commercial AC power supply (40) (hereinafter simply referred to as an AC power supply), a signal line (S) for transmitting the signal, and a common line (N) to be shared by the transmission of the AC power and transmission of the signal.

In this example, the power line (L) is connected to an R-phase of the AC power supply (40) in the outdoor unit (10), and the common line (N) is connected to an S-phase of the AC power supply (40) in the outdoor unit (10). That is, the indoor unit (20) is connected to the R-phase and the S-phase of the AC power supply (40) to supply a single-phase AC. The signal line (S) is used for transmission of AC power, which will be described later, in addition to the signal transmission. For this purpose, the signal line (S) employs a wiring material having a current carrying capacity suitable for grid power. In this embodiment, the wiring material used for the signal line (S) is the same as those used for the power line (L) and the common line (N).

<Outdoor Unit (10)>

The outdoor unit (10), serving as an electrical system, includes a first outdoor power supply circuit (14), a second outdoor power supply circuit (12), an outdoor unit transmission circuit (11), an outdoor control circuit (13), and relays (K13R, K14R, K15R).

—First Outdoor Power Supply Circuit (14)—

The first outdoor power supply circuit (14) converts a three-phase AC received from a main power supply line (1L) connected to the AC power supply (40) to a direct current (DC), and supplies the DC to a so-called intelligent power module (indicated as IPM in the drawings) and an outdoor fan motor. The intelligent power module converts the input DC to an AC having a predetermined frequency and a predetermined voltage, and supplies the AC to the motor of the electric compressor. In this example, the first outdoor power supply circuit (14) includes a noise filter (14*a*), two main relays (14*b*), two diode bridge circuits (14*c*), a reactor (14*d*), and a smoothing capacitor (14*e*).

The noise filter (14*a*) includes a capacitor and a coil. The two main relays (14*b*) are respectively provided on the supply lines of the R-phase and T-phase of the three-phase AC. The main relays (14*b*) are so-called A-contact relays. Specifically, each of the main relays (14*b*) includes one fixed contact and one movable contact, and when electric power is supplied to the coil of the main relay (14*b*), these contacts are connected to each other (i.e., turned on). One of the two diode bridge circuits (14*c*) receives the R-phase and the S-phase of the three-phase AC, the other receives the S-phase and the T-phase of the three-phase AC, the each of the received phases of the AC is subjected to full-wave rectification. Outputs of the diode bridge circuits (14*c*) are input to the smoothing capacitor (14*e*) through the reactor (14*d*), and smoothed by the smoothing capacitor (14*e*). The DC smoothed by the smoothing capacitor (14*e*) is supplied to the intelligent power module and the outdoor fan motor.

—Second Outdoor Power Supply Circuit (12)—

The second outdoor power supply circuit (12) converts the two phases of the R-phase and S-phase of the three-phase AC supplied from the main power supply line (1L) through a power supply wiring (1*a*) to a DC (5 V in this example), and supplies the DC to the outdoor control circuit (13). In this example, the second outdoor power supply circuit (12) includes a diode bridge circuit (12*a*), a smoothing capacitor (12*b*), and a switching power supply (12*c*). One of the inputs of the diode bridge circuit (12*a*) is connected to the power supply wiring (1*a*) of the R-phase of the three-phase AC through the relay (K13R), which will be specifically described later, and the other input of the diode bridge circuit (12*a*) is connected to the power supply wiring (1*a*) of the S-phase of the three-phase AC. An output of the diode bridge circuit (12*a*) is smoothed by the smoothing capacitor (12*b*), and then input to the switching power supply (12*c*). The switching power supply (12*c*) is, for example, a DC-to-DC converter, and converts an input DC to a predetermined voltage (5 V), and outputs the voltage to the outdoor control circuit (13).

—Outdoor Unit Transmission Circuit (11)—

The outdoor unit transmission circuit (11) performs signal communication with the indoor unit transmission circuit (21). In this communication, based on a potential difference between the signal line (S) and the common line (N), communication of a binary digital signal of a high level and a low level is performed. An end of a communication circuit (not shown) in the indoor unit transmission circuit (21) is connected to the common line (N), and the other end of the communication circuit is connected to the signal line (S) through the relay (K14R).

—Relay (K13R)—

The relay (K13R) is a switch that blocks a current flow in the power supply wiring (1*a*) and switches the outdoor unit (10) to a suspended state in which no electric power is supplied to the second outdoor power supply circuit (12) in an operation stop period, and is a relay for switching an AC supply path to the second outdoor power supply circuit (12). The relay (K13R) is a so-called C-contact relay. Specifically, the relay (K13R) includes two fixed contacts and one movable contact, and when no current flows in the coil of the relay (K13R), one of the fixed contacts (hereinafter referred to as a normally closed contact) is connected to the movable contact, whereas when current flows in the coil, the other fixed contact (hereinafter referred to as a normally opened contact) is connected to the movable contact. Switching of the relay (K13R) (whether current flows in the coil or not) is controlled by the outdoor control circuit (13).

In this example, the movable contact of the relay (K13R) is connected to the power supply wiring (1*a*) serving as the input of the diode bridge circuit (12*a*). The normally closed contact is connected to the signal line (S), and the normally opened contact is connected to the power supply wiring (1*a*) of the R-phase of the three-phase AC. That is, when no current flows in the coil of the relay (K13R), the normally closed contact and the movable contact are connected to each other, and one of the inputs of the diode bridge circuit (12*a*) is connected to the signal line (S). Once current has flown in the coil of the relay (K13R), the movable contact and the normally opened contact are connected to each other, and an AC is input to the diode bridge circuit (12*a*) of the second outdoor power supply circuit (12).

—Relay (K14R)—

The relay (K14R) is a relay for switching the connection between the signal line (S) and the outdoor unit transmission circuit (11) between connection and disconnection. The relay (K14R) is a so-called A-contact relay, and when current flows in the coil of the relay (K14R), the connection between the fixed contact and the movable contact are turned on. On/off operation of the relay (K14R) is controlled by the outdoor control circuit (13). In this example, the movable contact of the relay (K14R) is connected to the signal line (S), and the fixed contact of the relay (K14R) is connected to an end of a communication circuit (not shown) in the outdoor unit transmission circuit (11). Of course, in the A-contact relay, the correspondence between, for example, a signal to be input and each contact may be reversed.

—Relay (K15R)—

The relay (K15R) is a relay for switching the supply of power to the outdoor unit transmission circuit (11) between on and off. The relay (K15R) is a so-called A-contact relay. One of the contacts of the relay (K15R) is connected to a power supply node of the outdoor unit transmission circuit (11), and the other contact is connected to the R-phase of the three-phase AC. When the relay (K15R) is turned on, power is supplied to the outdoor unit transmission circuit (11), whereas when the relay (K15R) is turned off, power supply to the outdoor unit transmission circuit (11) is shut off. Turning on/off of the relay (K15R) is controlled by the outdoor control circuit (13).

—Outdoor Control Circuit (13)—

The outdoor control circuit (13) includes a microcomputer and a memory (not shown) storing a program for operating the microcomputer. In the outdoor control circuit (13), the outdoor unit transmission circuit (11), for example, controls the electric compressor and other components in response to a signal received from the indoor unit transmission circuit (21), and also controls start operation of the outdoor unit (10) (which will be specifically described later). When the air conditioner (1) is in a suspended state (i.e., in a state in which power consumption of the whole air conditioner (1) is the minimum, which will be described later), power supply to the outdoor control circuit (13) is shut off so that operation of the outdoor control circuit (13) stops.

<Indoor Unit (20)>

The indoor unit (20), serving as an electrical system, includes an indoor power supply circuit (22), an indoor unit transmission circuit (21), an indoor control circuit (23), a relay (K2R), a first diode (D1), and a second diode (D2).

—Indoor Power Supply Circuit (22)—

The indoor power supply circuit (22) includes a noise filter (22*a*), a diode bridge circuit (22*b*), a smoothing capacitor (22*c*), and a switching power supply (22*d*). The indoor power supply circuit (22) converts an AC supplied from the main power supply line (1L) through the power line (L) and the common line (N) to a DC (a DC at 5 V in this example), and supplies the DC to the indoor control circuit (23).

In this example, the noise filter (22*a*) includes two coils. The diode bridge circuit (22*b*) performs full-wave rectification on an AC input from the power line (L) and the common line (N) through the noise filter (22*a*). The smoothing capacitor (22*c*) is, for example, an electrolytic capacitor, and smooths an output of the diode bridge circuit (22*b*). The switching power supply (22*d*) is, for example, a DC-to-DC converter, converts the DC smoothed by the smoothing capacitor (22*c*) to a predetermined voltage (5 V), and inputs the predetermined voltage to the indoor control circuit (23).

—Indoor Unit Transmission Circuit (21)—

As described above, the indoor unit transmission circuit (21) performs signal communication with the outdoor unit transmission circuit (11). In this communication, communication of a digital signal is performed based on the potential difference between the signal line (S) and the common line (N). Thus, an end of a communication circuit of the indoor unit transmission circuit (21) is connected to the signal line (S) through the second diode (D2), and the other end of the communication circuit is connected to the common line (N).

—Relay (K2R), First and Second Diodes (D1, D2)—

The relay (K2R) is a so-called A-contact relay. In this embodiment, the relay (K2R) and the first diode (D1) are provided in the indoor unit (20), and are serially connected to each other between the power line (L) and the signal line (S). More specifically, a movable contact of the relay (K2R) is connected to the power line (L), and a fixed contact of the relay (K2R) is connected to a cathode of the first diode (D1). The anode of the first diode (D1) is connected to the signal line (S).

The relay (K2R) serves as a switch for switching connection between the power line (L) and the signal line (S) between on and off. On/off operation of the relay (K2R) is controlled by the indoor control circuit (23). The relay (K2R) is an example of an on/off switch of the present invention. The first diode (D1) inhibits an AC flowing into the indoor unit transmission circuit (21). The positional relationship between the first diode (D1) and the relay (K2R) may be reversed. Specifically, the positional relationship may be changed such that the cathode of the first diode (D1) is connected to the power line (L), the anode of the first diode (D1) is connected to one of the contacts of the relay (K2R), and the other contact of the relay (K2R) is connected to the signal line (S).

The anode of the second diode (D2) is connected to a connection node (ND1) between the first diode (D1) and the signal line (S), and the cathode thereof is connected to a signal input node (ND2) in the indoor unit transmission circuit (21). The second diode (D2) inhibits an AC flowing out of the indoor unit transmission circuit (21). In the air conditioner (1), since the common line (N) is connected to the S-phase of the AC power supply (40), the S-phase of the AC subjected to half-wave rectification in the second diode (D2) is superimposed on a communication signal between the indoor unit transmission circuit (21) and the outdoor unit transmission circuit (11). The first and second diodes (D1, D2) constitute an example of a protection circuit in this embodiment.

—Indoor Control Circuit (23)—

The indoor control circuit (23) includes a microcomputer and a memory (not shown) storing a program for operating the microcomputer. In response to an instruction from the remote controller (30), the indoor control circuit (23) controls a state (which will be described later) of the air conditioner (1). In order to receive an instruction from the remote controller (30), the indoor control circuit (23) is always supplied with power from the indoor power supply circuit (22).

<Remote Controller (30)>

The remote controller (30) accepts operation by a user, and transmits a signal in accordance with the operation of the user to the indoor control circuit (23). The user can perform operations such as operation start, operation stop, and temperature setting of the air conditioner (1) by button operation of the remote controller (30), for example. The remote controller (30) may be a so-called wired remote controller connected to the indoor control circuit (23) by a signal line or may be a so-called wireless remote controller that communicates with the indoor control circuit (23) by using an infrared ray or electric wave.

<Forced Start-up Mechanism>

A forced start-up mechanism, which is a feature of this embodiment, will now be described. A suspended state used in the following description is a standby mode of the present invention.

As illustrated in FIG. 1, in the outdoor unit (10), a selection mechanism (16) that determines whether to adapt the outdoor unit (10) to a unit that is able to transition to a suspended state or not, is provided in the power supply wiring (1*a*).

The selection mechanism (16) includes the relay (K13R), an auxiliary circuit (16*a*), an opening/closing unit (17), and a detection circuit (18) for the opening/closing unit (17). As described above, the relay (K13R) is a switch for causing the outdoor unit (10) to transition to the suspended state.

The auxiliary circuit (16*a*) includes a diode (16*b*), is connected in parallel with the relay (K13R), and connects the R-phase of the three-phase AC to the input of the second outdoor power supply circuit (12) such that power is always supplied to the outdoor control circuit (13).

Figure 7:
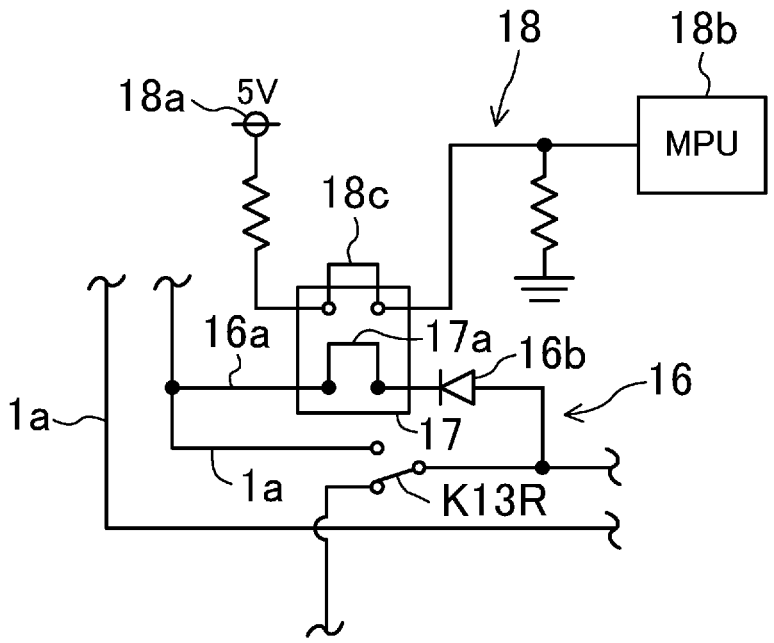
FIG. 7 is a circuit diagram schematically illustrating a selection mechanism.

As illustrated in FIG. 7, the opening/closing unit (17) is a connector for opening and closing the auxiliary circuit (16*a*), and includes a connection pin (17*a*). The opening/closing unit (17) causes current to flow in the auxiliary circuit (16*a*) when the connection pin (17*a*) is inserted in the opening/closing unit (17), and prevent current from flowing in the auxiliary circuit (16*a*) when the connection pin (17*a*) is removed. Thus, in installing the outdoor unit (10), an operator removes the connection pin (17*a*). That is, the operator determines whether the indoor unit (20) is a standby power reduction supporting model that can transition to the suspended state or a standby power reduction unsupporting model that cannot transition to the suspended state. If the operator determines that the indoor unit (20) is a standby power reduction supporting model, the operator removes the connection pin (17*a*). On the other hand, if the operator determines that the indoor unit (20) is a standby power reduction unsupporting model, the operator remains the connection pin (17*a*) inserted.

While the connection pin (17*a*) remains in the connector, power is always supplied to the outdoor control circuit (13) through the second outdoor power supply circuit (12).

As illustrated in FIG. 7, the detection circuit (18) includes a power supply (18*a*) and a microcomputer (18*b*) and also includes a linkage pin (18*c*) linked to the connection pin (17*a*). When the connection pin (17*a*) is inserted, the detection circuit (18) determines that a transition to the suspended state is not performed, and displays, for example, the impossibility of a transition to the suspended state.

<Operation of Air Conditioner>

Figure 2:
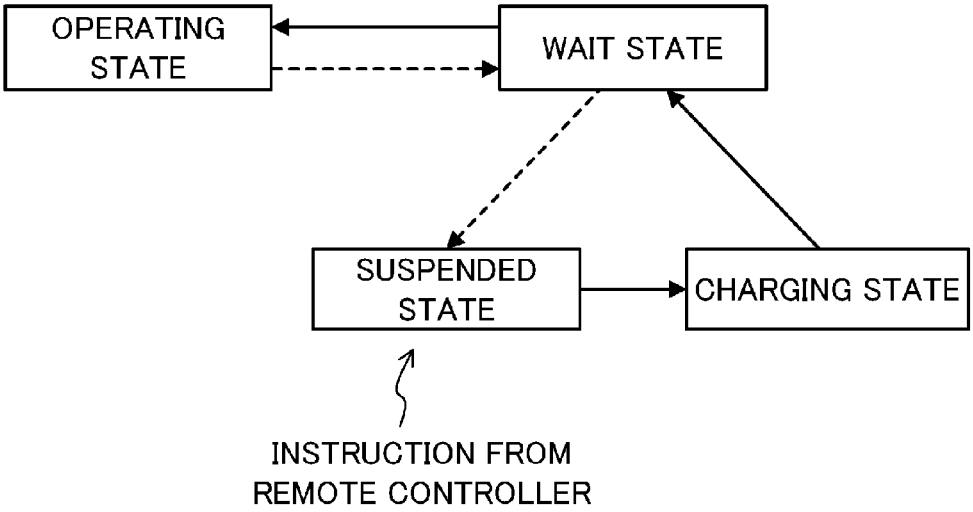
FIG. 2 is a state transition diagram of the air conditioner of the first embodiment.

FIG. 2 is a state transition diagram of the air conditioner (1). The air conditioner (1) transitions among four states: a suspended state, a charging state, a wait state, and an operating state, which will be described later. In the following description, standby power consumption refers to "steady-state power consumption when equipment is not used or waits for some input (e.g., an instruction indication)". Specifically, in the air conditioner (1), power consumption necessary for only waiting for an instruction from the remote controller (30) is standby power consumption.

(1) Suspended State

The suspended state is a state in which electric power is supplied to the indoor unit (20) and no electric power is supplied to the outdoor unit (10).

The suspended state of this embodiment is, for example, a state in which power consumption of the whole air conditioner (1) is the minimum. Specifically, in the suspended state of this embodiment, the outdoor unit (10) receives and supplies electric power to the indoor unit (20), but no electric power is supplied to, for example, the circuits and the electric compressor in the outdoor unit (10). In this manner, in the suspended state, power supply to the circuits in the outdoor unit (10) is shut off, thereby reducing standby power consumption.

On the other hand, standby power consumption of the indoor unit (20) is the minimum, and part of the indoor control circuit (23) responsible for signal reception from the remote controller (30) receives electric power from the indoor power supply circuit (22) and operates. Standby power consumption of the remote controller (30) is also the minimum, and can accept predetermined indications such as a time stamp and a button operation by a user. The degrees of power consumption (standby power consumption) of the indoor unit (20) and the remote controller (30) are not limited to those described herein.

(2) Charging State

For the outdoor unit (10), the charging state refers to a state from formation of a circuit for charging the smoothing capacitor (12*b*) of the second outdoor power supply circuit (12) to start of signal transmission between the outdoor unit transmission circuit (11) and the indoor unit transmission circuit (21). Power consumption of the indoor unit (20) in the charging state is similar to that in the suspended state.

(3) Wait State

The wait state refers to a state after the charging state when operation is started, and a state transitioned from an operating state (which will be described later) when operation is stopped. In both cases, the outdoor unit (10) is ready for, i.e., can promptly transition to, the operating state through the wait state. In the wait state, the outdoor unit transmission circuit (11) and the outdoor control circuit (13) can also operate. In particular, the wait state in an operation stop period (i.e., the wait state transitioned from the operating state) is provided in order to uniformize the refrigerant pressure in the electric compressor and to be used for scheduled operation in which an operation start and an operation stop are repeatedly performed. The wait state is 10 minutes, for example. Power consumption of the indoor unit (20) is similar to that in the suspended state.

(4) Operating State

The operating state refers to a state in which the main relays (14*b*) are on and the electric compressor and the outdoor fan are operable or in operation. This state also refers to a so-called phase interruption and a thermo-off state. In the indoor unit (20), the indoor fan, for example, becomes an operating state, and power consumption is larger than those in the above-described states. The remote controller (30) is in an operation instruction state (e.g., a state in which operating states are displayed).

—State Transition in Air Conditioner (1)—

To start operation, the air conditioner (1) transitions from the suspended state to the operating state in the order indicated by the continuous-line arrows in FIG. 2. To stop operation, the air conditioner (1) transitions from the operating state to the suspended state in the order indicated by the broken-line arrows in FIG. 2. An example of the transition from the suspended state to the operating state will be described.

<Electrical System in Suspended State>

First, a state of the electrical system in the suspended state will be described. FIG. 1 illustrates states of the relays in the suspended state. In the suspended state, in the outdoor unit (10), no current flows in the coils of the main relays (14*b*), and no power is supplied from the first outdoor power supply circuit (14) to any of the intelligent power module and the outdoor fan motor. In the outdoor unit (10), no current flows in the coils of the other relays (K13R, K14R, K15R), either. Thus, the relay (K14R) and the relay (K15R) are off. That is, the outdoor unit transmission circuit (11) and the signal line (S) are disconnected from each other, and supply of power is shut off. The relay (K13R) is switched to a state in which the normally closed contact is connected to the movable contact. That is, one of the inputs of the diode bridge circuit (12*a*) of the second outdoor power supply circuit (12) is connected to the signal line (S). In this state, no current flows in the second outdoor power supply circuit (12), and the outdoor control circuit (13) is not supplied with power. In this manner, in the suspended state, standby power consumption of the outdoor unit (10) can be eliminated.

In the indoor unit (20) in the suspended state, no current flows in the coil of the relay (K2R), and the relay (K2R) is in the off state. That is, the signal line (S) is not electrically connected to the power line (L). As described above, in the indoor unit (20), a portion of the indoor control circuit (23) responsible for signal reception from the remote controller (30) operates while being supplied with power from the indoor power supply circuit (22).

<Transition from Suspended State to Charging State>

Figure 3:
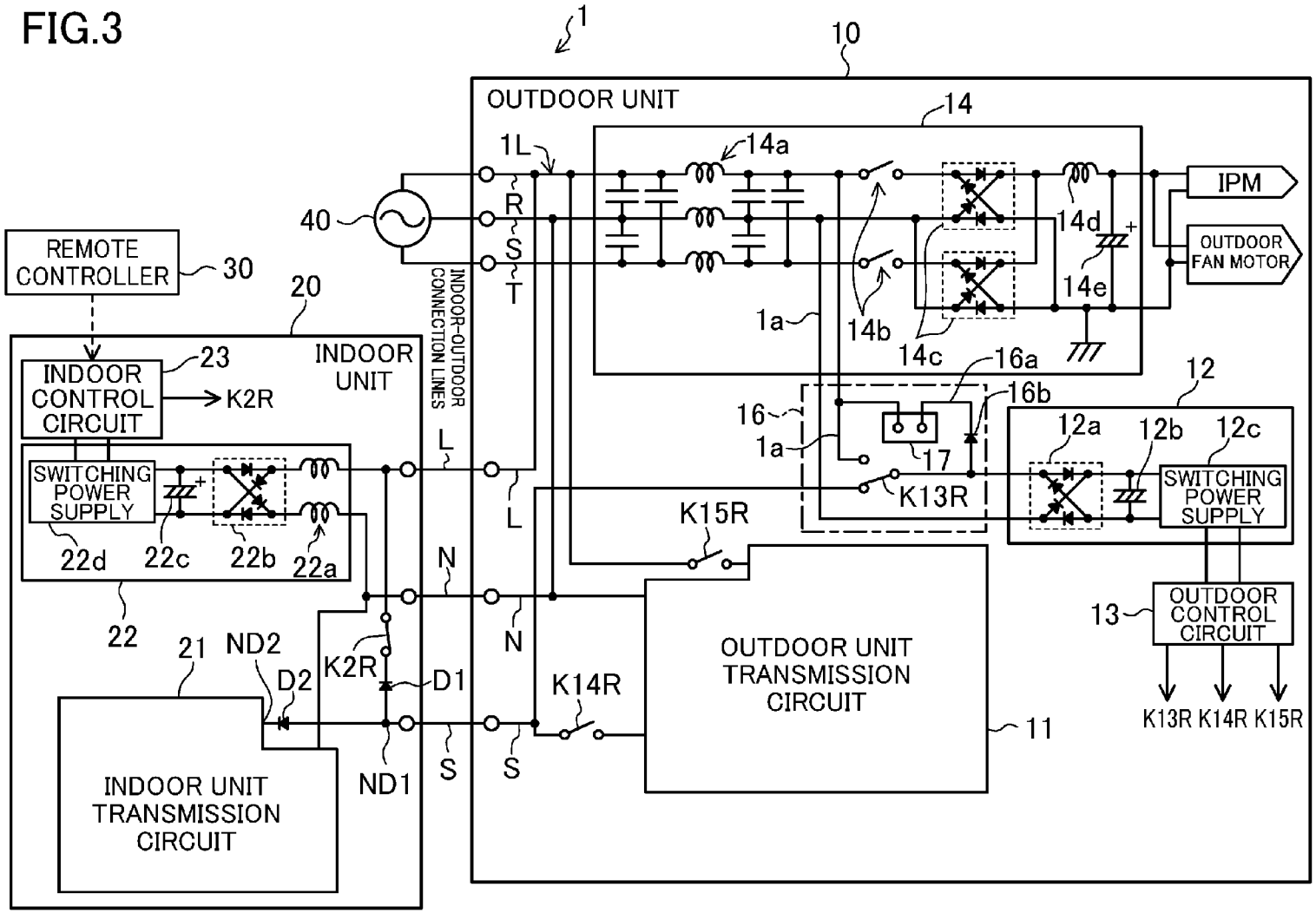
FIG. 3 illustrates states of relays when a circuit for charging a smoothing capacitor is formed.
Figure 4:
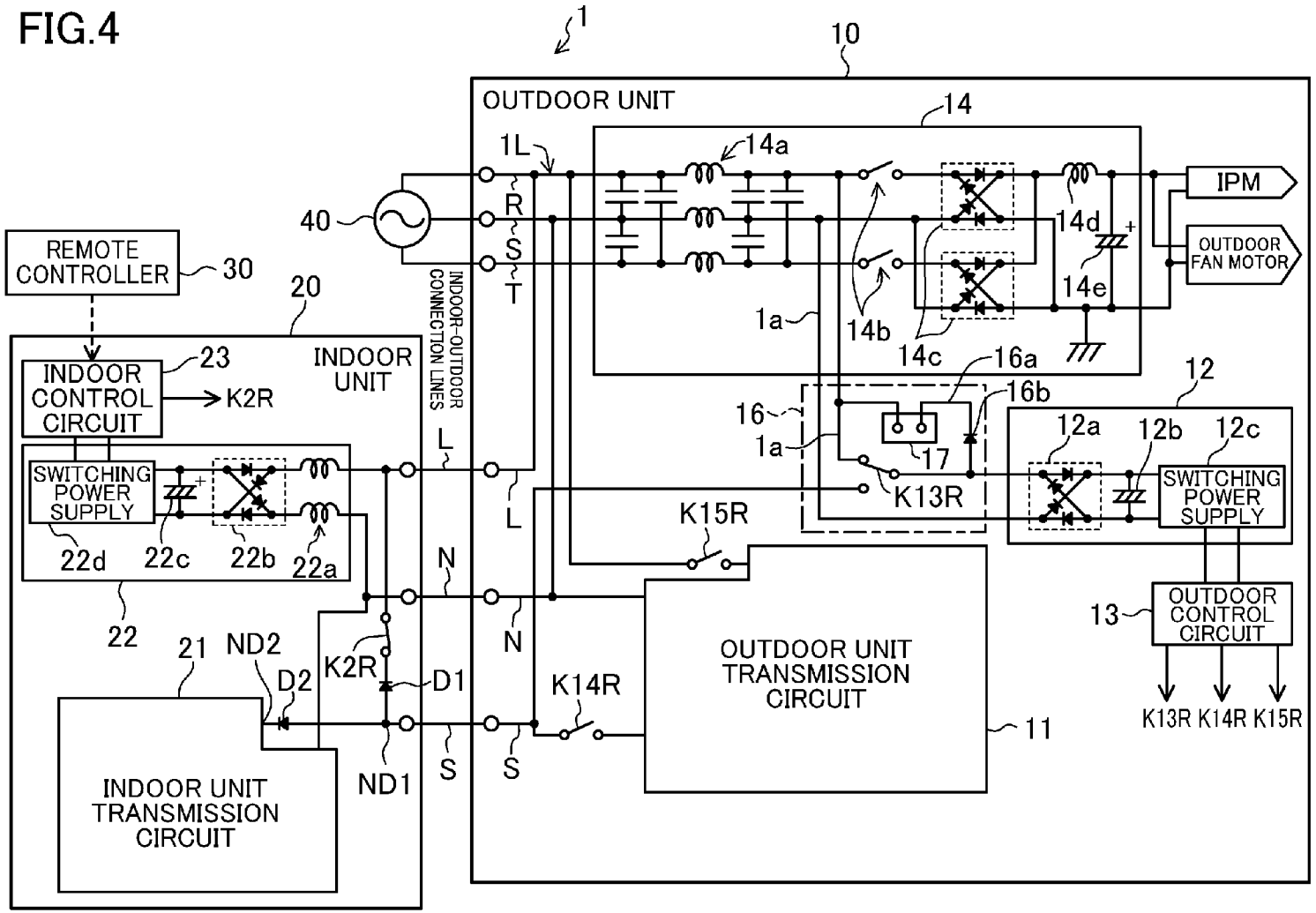
FIG. 4 illustrates states of the relays after completion of transition to a charging state.

FIG. 3 illustrates states of the relays at the time when a circuit for charging the smoothing capacitor (12*b*) is formed. FIG. 4 illustrates states of the relays after transition to the charging state has been completed. For example, when the user operates the remote controller (30) and instructs an operation start (e.g., start of cooling operation) of the air conditioner (1), the indoor control circuit (23) causes current to flow in the coil of the relay (K2R). Then, in the air conditioner (1), a power transmission path (which will be hereinafter referred to as a power transmission path at start for convenience of description) from the R-phase of the three-phase AC to one of the inputs of the diode bridge circuit (12*a*) via the power line (L), the relay (K2R), the first diode (D1), the signal line (S), and the relay (K13R) is formed. The other input of the diode bridge circuit (12*a*) is connected to the S-phase of the three-phase AC, and thus, a single-phase AC subjected to half-wave rectification in the first diode (D1) is supplied to the diode bridge circuit (12*a*). That is, a circuit for charging the smoothing capacitor (12*b*) is formed (see FIG. 3).

At this time, in a situation where the potential of the R-phase of the three-phase AC is higher than the potential of the S-phase (i.e., an AC flows from the R-phase to the S-phase), the first diode (D1) inhibits an AC flowing from the power line (L) into the indoor unit transmission circuit (21) and the outdoor unit (10). The indoor unit transmission circuit (21) is connected to the R-phase through the indoor power supply circuit (22), but an AC flowing from the indoor unit transmission circuit (21) to the signal line (S) is inhibited by the second diode (D2).

In a situation where the potential of the S-phase of the three-phase AC is higher than the potential of the R-phase (i.e., an AC flows from the S-phase to the R-phase), current flows in the diode bridge circuit (12*a*). In this case, an end of the communication circuit in the indoor unit transmission circuit (21) is connected to the S-phase of the three-phase AC through the common line (N), and the other end of the communication circuit is connected to the S-phase of the three-phase AC through the signal line (S), the relay (K13R), and the diode bridge circuit (12*a*). That is, the indoor unit transmission circuit (21) is connected to only one phase of the three-phase AC. Thus, even when the signal line (S) is used for transmission of AC power, no AC current flows in the communication circuit in the indoor unit transmission circuit (21). In the foregoing manner, the outdoor unit transmission circuit (11) is protected against overvoltage.

Once the smoothing capacitor (12*b*) has been charged so that the input to the switching power supply (12*c*) is stabilized and the switching power supply (12*c*) is allowed to output a specific DC voltage (5 V in this example), the outdoor control circuit (13) is started. The outdoor control circuit (13) then causes current to flow in the coil of the relay (K13R), and connects the normally opened contact point to the movable contact. In this manner, one of the inputs of the diode bridge circuit (12*a*) is connected to the R-phase of the three-phase AC through the power transmission path in the outdoor unit (10). That is, the outdoor control circuit (13) switches to a state in which power is supplied from the AC power supply (40) not passing through the signal line (S) (see FIG. 4). Then, transition to the charging state is completed in the air conditioner (1).

<Transition from Charging State to Wait State>

Figure 5:
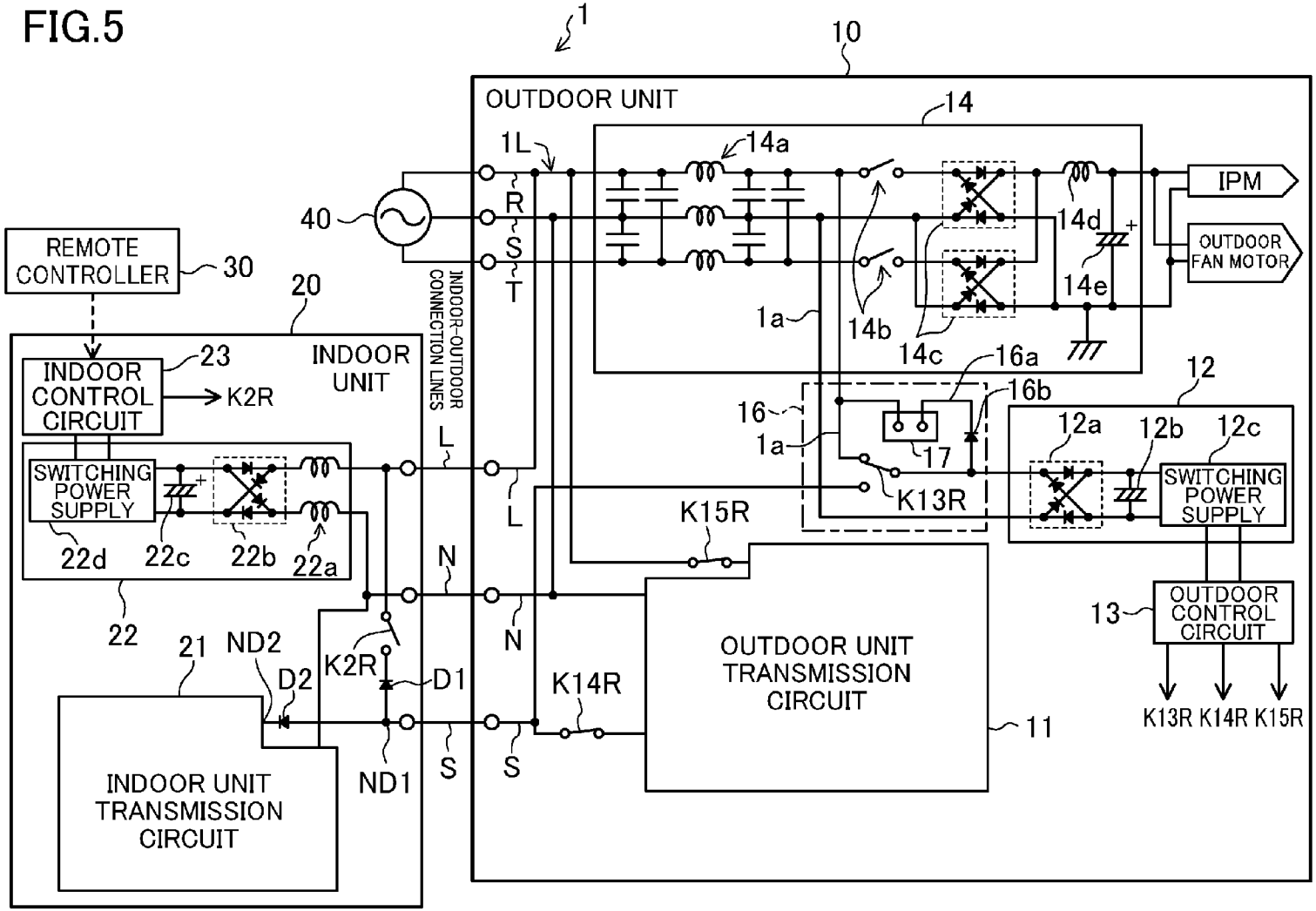
FIG. 5 illustrates states of the relays when transition to a wait state is completed.

FIG. 5 illustrates states of the relays when transition to the wait state is completed. In the indoor unit (20), after a lapse of a predetermined time (a time sufficient for start of the outdoor control circuit (13)) from turning on of the relay (K2R), the relay (K2R) is turned off. In this manner, the signal line (S) can be used for signal transmission.

In the outdoor unit (10), after the relay (K2R) has been turned off, the outdoor control circuit (13) turns the relay (K15R) on so that electric power is supplied to the outdoor unit transmission circuit (11), and the outdoor control circuit (13) turns the relay (K14R) on. In this manner, the communication circuit in the outdoor unit transmission circuit (11) is connected to the indoor unit transmission circuit (21) through the signal line (S) and the common line (N), and are allowed to communicate with the indoor unit transmission circuit (21). Thus, the air conditioner (1) transitions to a state (i.e., the wait state) in which the air conditioner (1) is ready for transition to the operating state immediately through the charging state.

<Transition from Wait State to Operating State>

Figure 6:
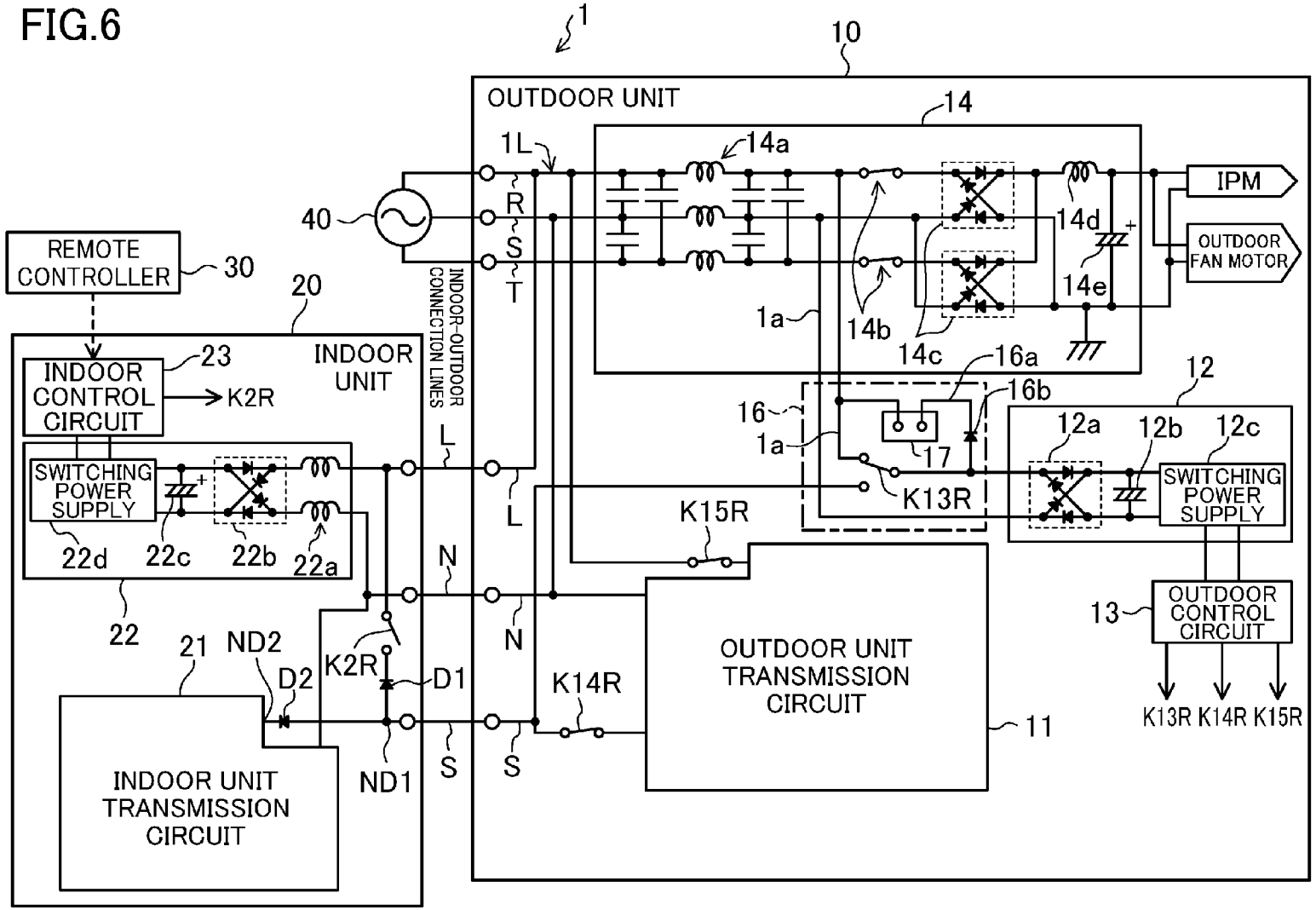
FIG. 6 illustrates states of the relays in an operating state.

FIG. 6 illustrates states of the relays in the operating state. In transition from the wait state to the operating state, the outdoor control circuit (13) turns the two main relays (14*b*) on. Then, the first outdoor power supply circuit (14) supplies power to the intelligent power module and the outdoor fan motor so that the electric compressor and other components come to be in the operating state and cooling operation, for example, is performed.

<Operation of Forced Start-Up Operation>

Forced start-up operation, which is a feature of this embodiment, will now be described.

In installing the outdoor unit (10), the operator determines whether the indoor unit (20) is a standby power reduction supporting model that can transition to the suspended state or a standby power reduction unsupporting model that cannot transition to the suspended state. If the indoor unit (20) is a standby power reduction supporting model, the operator removes the connection pin (17*a*) from the opening/closing unit (17) that is a connector. Consequently, power supply to the auxiliary circuit (16*a*) is shut off, and the relay of the power supply wiring (1*a*) is turned on or off as described above, and the outdoor unit (10) transitions to the suspended state in an operation stop period.

On the other hand, if the indoor unit (20) is a standby power reduction unsupporting model, the operator remains the connection pin (17*a*) in the opening/closing unit (17). In this case, in the outdoor unit (10), current flows in the auxiliary circuit (16*a*), and electric power is always supplied from the AC power supply (40) to the outdoor control circuit (13) through second outdoor power supply circuit (12). Consequently, the outdoor unit (10) does not transition to the suspended state, and independently of the switching state of the relay (K13R), the outdoor unit (10) is started based on an operation signal of the remote controller (30).

While the connection pin (17*a*) remains in the opening/closing unit (17), the detection circuit (18) determines that no transition to the suspended state is performed, and displays impossibility of transition to the suspended state, for example.

<Advantages of First Embodiment>

As described above, in this embodiment, the selection mechanism (16) determines whether to adapt the outdoor unit (10) to a unit that is able to transition to the suspended state in which no electric power is supplied to the outdoor unit (10) in an operation stop period or not. Thus, in a situation where the air conditioner (1) includes a standby power reduction unsupporting model that cannot transition to the suspended state, transition to the suspended state of the outdoor unit (10) can be inhibited. As a result, even in the presence of the standby power reduction unsupporting model, reliability can be enhanced with smooth operation.

In addition, whether to adapt the outdoor unit (10) to a unit that is able to transition to the suspended state is selected by opening/closing the auxiliary circuit (16*a*). Thus, it is ensured that the outdoor unit (10) is adapted to a standby power reduction unsupporting model can be ensured, independently of operation of the relay (K13R) of the power supply wiring (1*a*).

In addition, since the opening/closing unit (17) is the connector, it is ensured that the outdoor unit (10) is adapted to a standby power reduction unsupporting model with a simple configuration.

<First Variation of First Embodiment>

Figure 8:
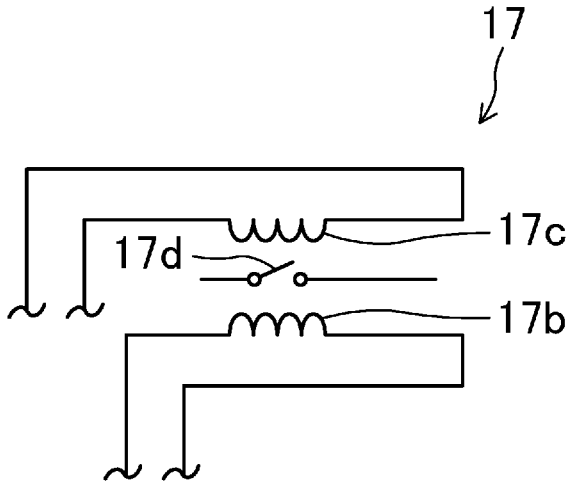
FIG. 8 schematically illustrates a latching relay according to a first variation of the first embodiment.

As illustrated in FIG. 8, in a first variation, the opening/closing unit (17) is a latching relay, unlike the first embodiment in which the opening/closing unit (17) is the connector.

The opening/closing unit (17) includes a setup coil (17*b*), a reset coil (17*c*), and a movable flap (17*d*). When the opening/closing unit (17) applies a voltage to the setup coil (17*b*), the movable flap (17*d*) is maintained in a state in which the auxiliary circuit (16*a*) is on. When the opening/closing unit (17) applies a voltage to the reset coil (17*c*), the movable flap (17*d*) is maintained in a state in which electric power is not supplied to the auxiliary circuit (16*a*). Once the auxiliary circuit (16*a*) has been opened or closed, the opening/closing unit (17) maintains the current state without application of a voltage to the setup coil (17*b*) and the reset coil (17*c*).

Thus, in installing the outdoor unit (10), if the indoor unit (20) is a standby power reduction supporting model, the operator determines application of a voltage to the reset coil (17*c*) so that the auxiliary circuit (16*a*) turns off.

On the other hand, if the indoor unit (20) is a standby power reduction unsupporting model, the operator determines application of a voltage to the setup coil (17*b*) to turn on the auxiliary circuit (16*a*).

Thus, since the opening/closing unit (17) is the latching relay, the opening/closing unit (17) automatically opens or closes, thereby enhancing operability. Other parts of the configuration, operation, and advantages are similar to those of the first embodiment.

<Second Variation of First Embodiment>

Figure 9:
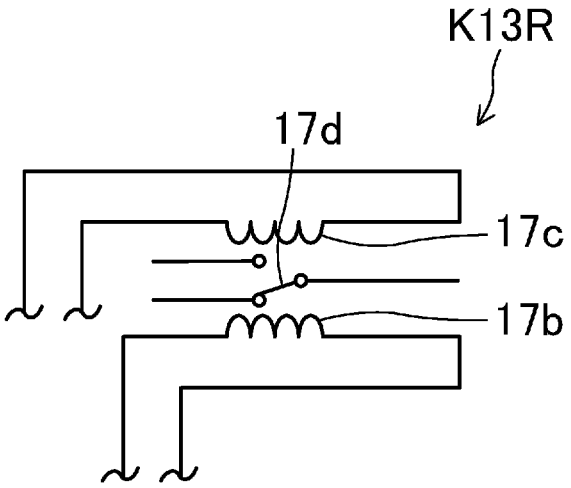
FIG. 9 schematically illustrates a relay according a second variation of the first embodiment.

As illustrated in FIG. 9, in a second variation, the relay (K13R) of the power supply wiring (1*a*) is similar to the latching relay of the first variation. Specifically, the relay (K13R) includes a setup coil (17*b*), a reset coil (17*c*), and a movable flap (17*d*).

If the indoor unit (20) is a standby power reduction supporting model, opening/closing operation of the relay (K13R) of the first embodiment is performed by the latching relay.

On the other hand, if the indoor unit (20) is a standby power reduction unsupporting model, a voltage is applied to the setup coil (17*b*), and the power supply wiring (1*a*) is kept conductive. Consequently, the outdoor unit (10) does not transition to the suspended state, and independently starts based on an operation signal of the remote controller (30). In this variation, the auxiliary circuits (16*a*) of the first embodiment and the first variation are not provided.

Thus, since the relay (K13R) of the power supply wiring (1*a*) is the latching relay, one latching relay can be used for both control of transition to the suspended state and adapting the outdoor unit (10) to a standby power reduction unsupporting model. As a result, the configuration can be simplified. Other parts of the configuration, operation, and advantages are similar to those of the first embodiment.

<Other Variations of First Embodiment>

The relay (K2R) may be replaced by a semiconductor switch (e.g., a transistor).

The commercial AC power supply (40) may supply a single-phase AC.

In the first embodiment and the variations thereof, the selection mechanism (16) conducts determination based on whether the indoor unit (20) is a standby power reduction supporting model or not. Alternatively, the determination of the selection mechanism (16) may be based on whether the remote controller, for example, is a standby power reduction supporting model or not.

<Second Embodiment>

<Overall Configuration>

Figure 10:
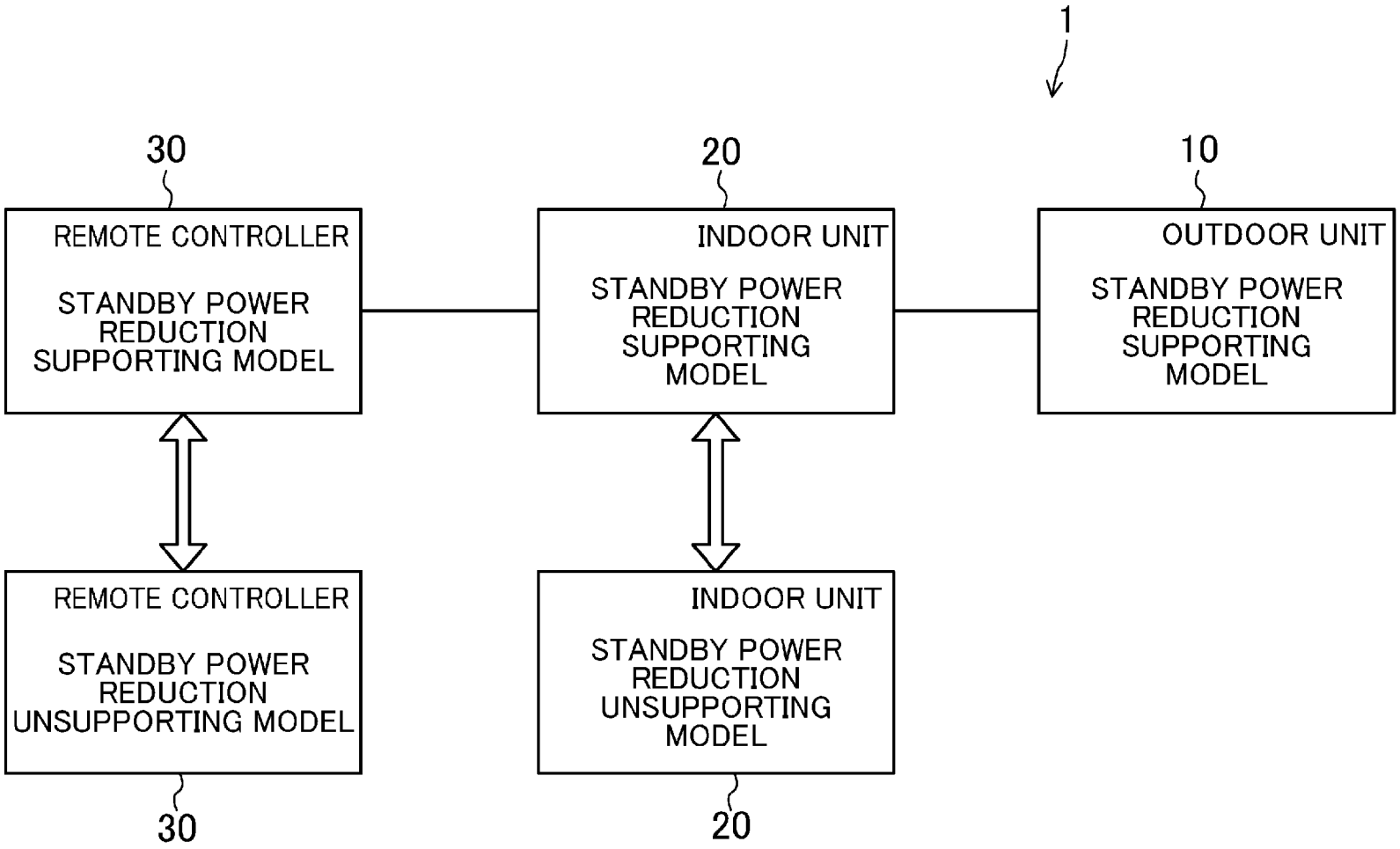
FIG. 10 illustrates an overall configuration of an air conditioner according to a second embodiment.

FIG. 10 illustrates an overall configuration of an air conditioner (1) according to a second embodiment of the present invention. The air conditioner (1) is an air conditioner that can employ a combination of an indoor unit and an outdoor unit having different device model specifications.

The air conditioner (1) includes an outdoor unit (10), an indoor unit (20), and a remote controller (30).

The outdoor unit (10) is a standby power reduction supporting model that can shut off a power supply in an operation stop period.

The indoor unit (20) may be a standby power reduction supporting model including a start-up unit that starts a power supply of the outdoor unit (10) of the standby power reduction supporting model to which a power supply is shut off and starts the outdoor unit (10). Alternatively, the indoor unit (20) may be a standby power reduction unsupporting model including no start-up unit.

The remote controller (30) may be a standby power reduction supporting model that transmits a shutoff request signal for shutting off the power supply to the outdoor unit (10) to the indoor unit (20). Alternatively, the remote controller (30) may be a standby power reduction unsupporting model that does not transmit the shutoff request signal to the indoor unit (20).

The second embodiment will now be more specifically described.

Figure 11:
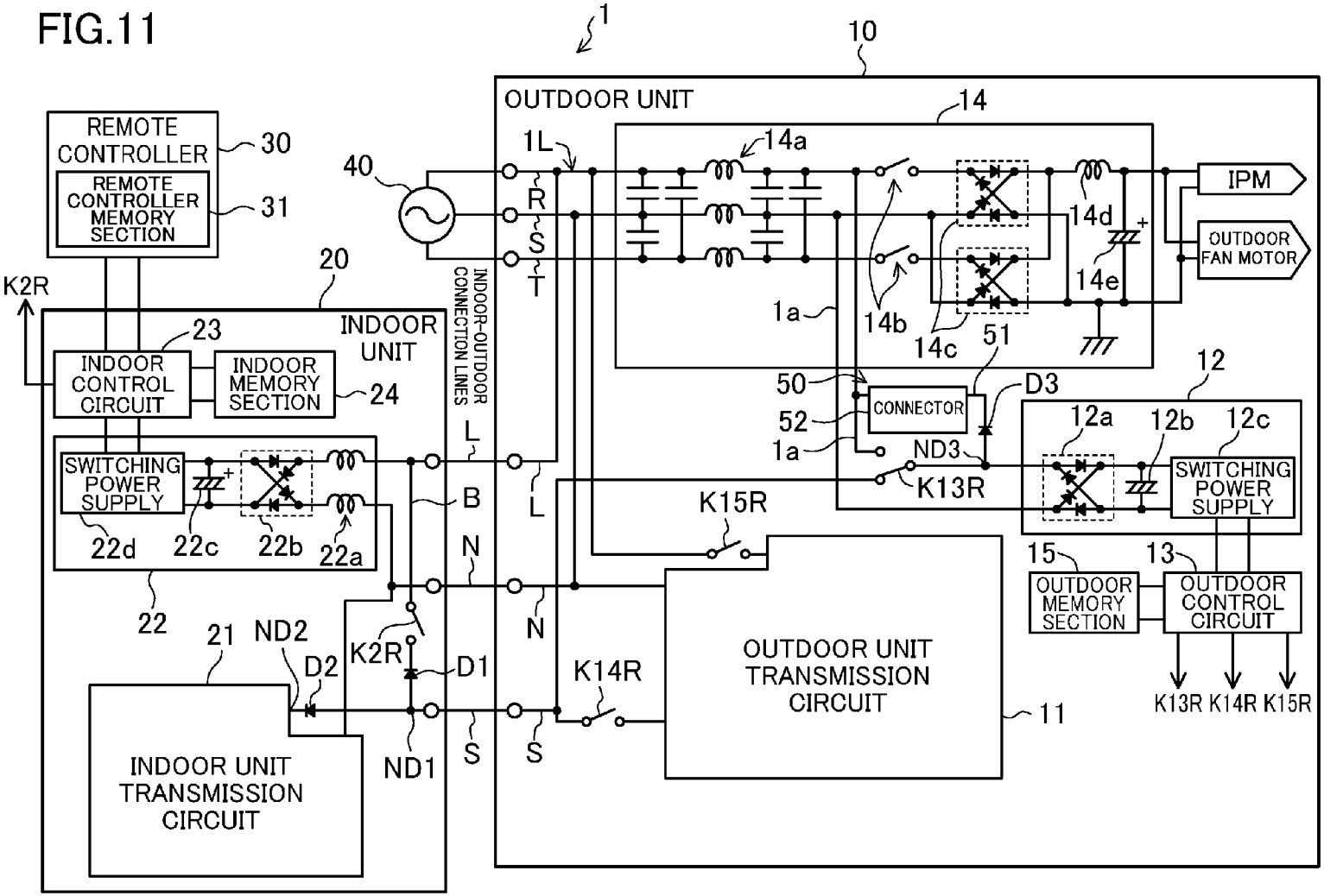
FIG. 11 is an electrical system block diagram of the air conditioner (in a suspended state) when an outdoor unit, an indoor unit that is a standby power reduction supporting model, a remote controller that is a standby power reduction supporting model are connected to one another.

FIG. 11 is an electrical system block diagram of the air conditioner (1) in a situation where the outdoor unit (10), the indoor unit (20) of a standby power reduction supporting model, and the remote controller (30) of a standby power reduction supporting model are connected to one another.

In the air conditioner (1), the outdoor unit (10) receives an AC (a three-phase AC at 200 V in this example) from a commercial AC power supply (40) and uses the AC as electric power for circuits and an electric compressor (not shown) in the outdoor unit (10). The outdoor unit (10) also supplies part of the three-phase AC corresponding to two phases to the indoor unit (20). Communication is performed between the outdoor unit (10) and the indoor unit (20) in order to control the outdoor unit (10) from the indoor unit (20). For this purpose, the air conditioner (1) includes, between the outdoor unit (10) and the indoor unit (20), three lines (indoor-outdoor communication lines): a power line (L) for transmitting AC power from the commercial AC power supply (40) (hereinafter referred to as an AC power supply), a signal line (S) for transmitting the signal, and a common line (N) to be shared by transmission of the AC power and transmission of the signal. In this embodiment, the power line (L) is connected to an R-phase of the AC power supply (40) in the outdoor unit (10), and the common line (N) is connected to an S-phase of the AC power supply (40) in the outdoor unit (10). That is, the indoor unit (20) is connected to the R-phase and the S-phase of the AC power supply (40) to supply the single-phase AC.

<Outdoor Unit (10)>

The outdoor unit (10), serving as an electrical system, includes a first outdoor power supply circuit (14), a second outdoor power supply circuit (12), an outdoor unit transmission circuit (11), an outdoor control circuit (13), an outdoor memory section (15), a forced start-up mechanism (50), and relays (K13R, K14R, K15R). Although not shown, the outdoor unit (10) includes equipment including an electric compressor, an outdoor heat exchanger, an outdoor fan, and an expansion valve.

—First Outdoor Power Supply Circuit (14)—

The first outdoor power supply circuit (14) converts a three-phase AC received from a main power supply line (1L) connected to the AC power supply (40) to a direct current (DC), and supplies the DC to a so-called intelligent power module (hereinafter referred to as an IPM) and an outdoor fan motor. The IPM converts the input DC to an AC having a predetermined frequency and a predetermined voltage, and supplies the AC to the motor of the electric compressor. The first outdoor power supply circuit (14) includes a noise filter (14*a*), two main relays (14*b*), two diode bridge circuits (14*c*), a reactor (14*d*), and a smoothing capacitor (14*e*).

The noise filter (14*a*) includes a capacitor and a coil. The two main relays (14*b*) are respectively provided on the supply lines of the R-phase and T-phase of the three-phase AC. One of the two diode bridge circuits (14*c*) receives the R-phase and the S-phase of the three-phase AC, the other receives the S-phase and the T-phase of the three-phase AC, and each of the received phase of the AC is subjected to full-wave rectification. Outputs of the diode bridge circuits (14*c*) are input to the smoothing capacitor (14*e*) through the reactor (14*d*), and smoothed by the smoothing capacitor (14*e*). The DC smoothed by the smoothing capacitor (14*e*) is supplied to the IPM and the outdoor fan motor.

—Second Outdoor Power Supply Circuit (12)—

The second outdoor power supply circuit (12) converts the two phases of the R-phase and S-phase of the three-phase AC supplied from the main power supply line (1L) through a power supply wiring (1*a*) to a DC (5 V in this example), and supplies the DC to the outdoor control circuit (13). The second outdoor power supply circuit (12) includes a diode bridge circuit (12*a*), a smoothing capacitor (12*b*), and a switching power supply (12*c*).

One of the inputs of the diode bridge circuit (12*a*) is connected to the power supply wiring (1*a*) of the R-phase of the three-phase AC through the relay (K13R), and the other is connected to the power supply wiring (1*a*) of the S-phase of the three-phase AC. An output of the diode bridge circuit (12*a*) is smoothed by the smoothing capacitor (12*b*), and then input to the switching power supply (12*c*). The switching power supply (12*c*) is, for example, a DC-to-DC converter, and converts an input DC to a predetermined voltage (5 V), and outputs the voltage to the outdoor control circuit (13).

—Outdoor Unit Transmission Circuit (11)—

The outdoor unit transmission circuit (11) performs signal communication with the indoor unit transmission circuit (21). In this communication, based on a potential difference between the signal line (S) and the common line (N), communication of a binary digital signal of a high level and a low level is performed. An end of a communication circuit (not shown) in the indoor unit transmission circuit (21) is connected to the common line (N), and the other end of the communication circuit is connected to the signal line (S) through the relay (K14R).

—Relay (K13R)—

The relay (K13R) is a switch that shuts off a power supply in the power supply wiring (1*a*) of the R-phase of the three-phase AC in an operation stop period to stop a power supply from the AC power supply (40) to the second outdoor power supply circuit (12), and is a relay for switching an AC supply path to the second outdoor power supply circuit (12). The relay (K13R) is a so-called C-contact relay. Specifically, the relay (K13R) includes two fixed contacts and one movable contact, and when no current flows in the coil (not shown) of relay (K13R), one of the fixed contacts (hereinafter referred to as a normally closed contact) is connected to the movable contact, whereas when current flows in the coil, the other fixed contact (hereinafter referred to as a normally opened contact) is connected to the movable contact. Switching of the relay (K13R) (whether current flows in the coil or not) is controlled by the outdoor control circuit (13).

The movable contact of the relay (K13R) is connected to the input of the diode bridge circuit (12*a*). The normally closed contact is connected to the signal line (S), and the normally opened contact is connected to the power supply wiring (1*a*) of the R-phase of the three-phase AC. That is, when no current flows in the coil of the relay (K13R), the normally closed contact and the movable contact are connected to each other, and one of the inputs of the diode bridge circuit (12*a*) is connected to the signal line (S). Once current has flown in the coil of the relay (K13R), the movable contact and the normally opened contact are connected to each other, and an AC is input to the diode bridge circuit (12*a*) of the second outdoor power supply circuit (12).

—Relay (K14R)—

The relay (K14R) switches between a connection state (an on state) in which the signal line (S) and the outdoor unit transmission circuit (11) are connected to each other and a disconnection state (an off state) in which the signal line (S) and the outdoor unit transmission circuit (11) are not connected to each other. On/off operation of the relay (K14R) is controlled by the outdoor control circuit (13).

—Relay (K15R)—

The relay (K15R) is a relay for switching the supply of power to the outdoor unit transmission circuit (11) between on and off. When the relay (K15R) is turned on, electric power is supplied to the outdoor unit transmission circuit (11) from the AC power supply (40), whereas when the relay (K15R) is turned off, power supply from the AC power supply (40) to the outdoor unit transmission circuit (11) to is stopped. On/off operation of the relay (K15R) is controlled by the outdoor control circuit (13).

—Outdoor Control Circuit (13)—The outdoor control circuit (13) includes a microcomputer and a memory storing a program for operating the microcomputer. In the outdoor control circuit (13), the outdoor unit transmission circuit (11), for example, controls the electric compressor and other components in response to a signal received from the indoor unit transmission circuit (21), and also controls start operation of the outdoor unit (10).

—Outdoor Memory Section (15)—

The outdoor memory section (15) is connected to the outdoor control circuit (13).

In the outdoor memory section (15) previously stores device model specification information ("1" or "0" bit) indicating whether the outdoor unit (10) is a standby power reduction supporting model or not.

—Forced Start-Up Mechanism (50)—

Figure 12:
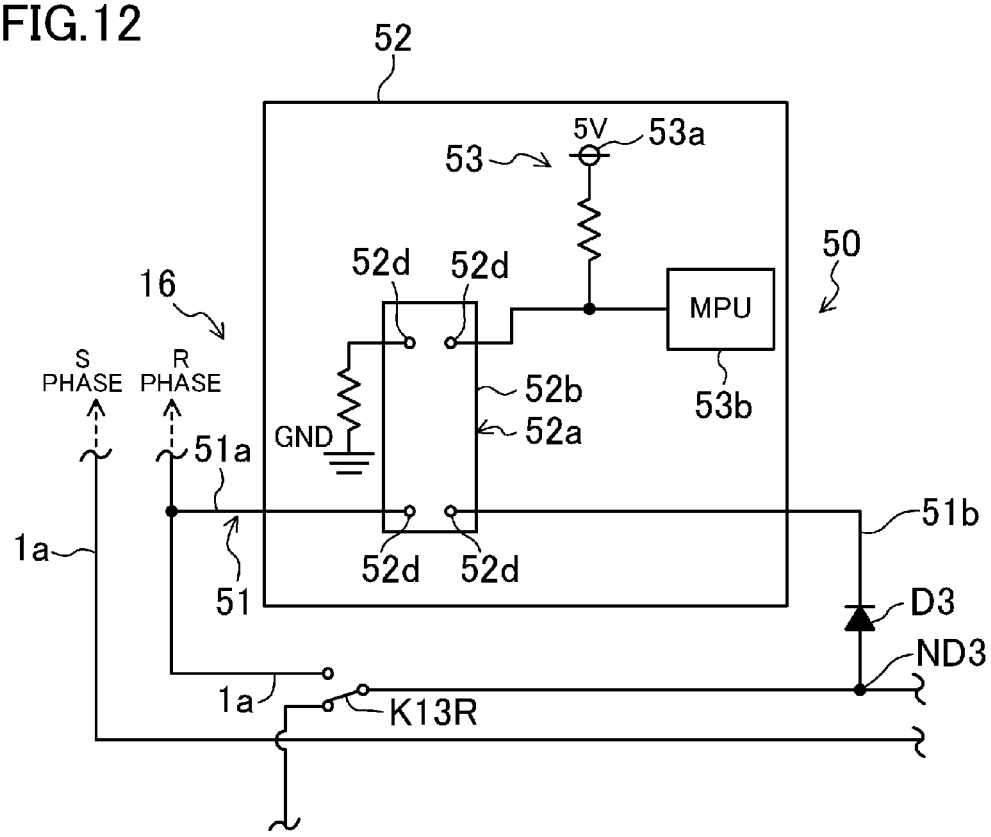
FIG. 12 is an enlarged view illustrating a portion around a forced start-up mechanism.

The forced start-up mechanism (50) is a mechanism for forcedly starting the outdoor unit (10) when the indoor unit (20) that is a standby power reduction unsupporting model is connected to the outdoor unit (10). As illustrated in FIGS. 11 and 12, the forced start-up mechanism (50) includes an auxiliary circuit (51) connected to the power supply wiring (1*a*) of the R-phase of the three-phase AC and bypassing the relay (K13R), and a connection point (52). The forced start-up mechanism (50), a short-circuit detector (53), which will be described later, a failure detector of the indoor control circuit (23), which will be described later, and the relay (K13R) constitute the selection mechanism (16) of the first embodiment.

The auxiliary circuit (51) includes a first short-circuit line (51*a*) connected to an end of the power supply wiring (1*a*) of the R-phase of the three-phase AC toward the normally opened contact point of the relay (K13R) and a second short-circuit line (51*b*) connected to an end of the power supply wiring (1*a*) of the R-phase of the three-phase AC toward the movable contact of the relay (K13R).

The second short-circuit line (51*b*) is provided with a diode (D3) whose anode is connected to a connection node (ND3) between the second short-circuit line (51*b*) and the power supply wiring (1*a*).

The connection point (52) includes a short-circuit connector (52*a*) that can connect the first short-circuit line (51*a*) and the second short-circuit line (51*b*) to each other and a short-circuit detector serving as a short-circuit detector that detects connection between the short-circuit lines (51*a*, 51*b*).

Figure 13:
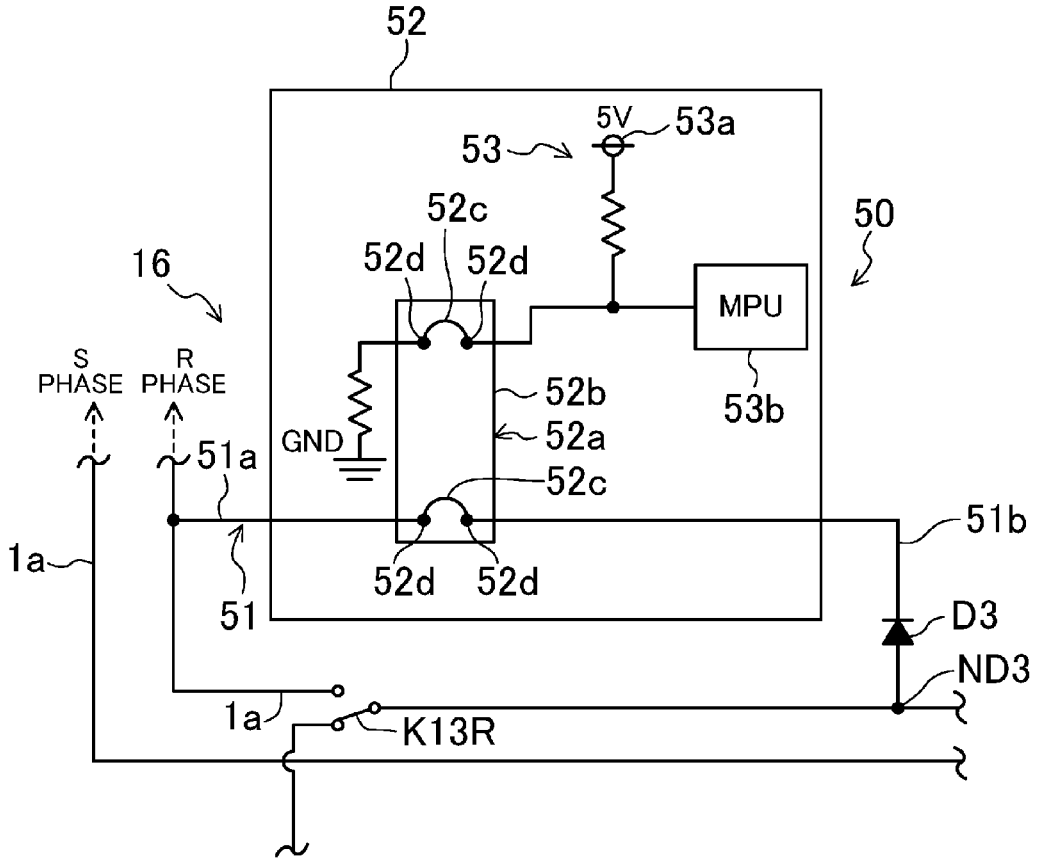
FIG. 13 is a view illustrating a state in which a connector plug is inserted in a short-circuit connector, and corresponds to FIG. 12.

The short-circuit connector (52*a*) includes a connector body (52*b*) and a four-pin connector plug (52*c*) (see FIG. 13).

The connector body (52*b*) has four plug insertion holes (52*d*, 52*d*, . . . ) for the connector plug (52*c*). The first and second short-circuit lines (51*a*, 51*b*) are connected to corresponding portions of the plug insertion holes (52*d*, 52*d*) of the plug insertion holes (52*d*, 52*d*, . . . ).

A short-circuit detector (53) includes a terminal connected to ground (GND), an external power supply terminal (53*a*) for receiving an external power supply (5 V in this example), and a microprocessor (53*b*) (hereinafter referred to as an MPU) serving as a detector connected to the external power supply terminal (53*a*) through a resistor.

The ground (GND) is connected to one of the two plug insertion holes (52*d*, 52*d*) not connected to the first and second short-circuit lines (51*a*, 51*b*) through a resistor, and the external power supply terminal (53*a*) and the MPU (53*b*) are connected to the other of the two plug insertion holes (52*d*, 52*d*).

In the forced start-up mechanism (50), when the connector plug (52*c*) is inserted in the plug insertion holes (52*d*, 52*d*, . . . ) of the connector body (52*b*), the first and second short-circuit lines (51*a*, 51*b*) are connected to each other so that the auxiliary circuit (51) turns on and the external power supply terminal (53*a*) and ground (GND) are connected to each other. On the other hand, when the connector plug (52*c*) is removed from the plug insertion holes (52*d*, 52*d*, . . . ) of the connector body (52*b*), the first and second short-circuit lines (51*a*, 51*b*) are disconnected from each other so that the auxiliary circuit (51) turns off and the external power supply terminal (53*a*) and the ground (GND) are disconnected from each other. In view of this, a high voltage is applied to the MPU (53*b*) while the short-circuit connector (52*a*) disconnects the short-circuit lines (51*a*, 51*b*) from each other, whereas a low voltage is applied to the MPU (53*b*) while the short-circuit connector (52*a*) connects the short-circuit lines (51*a*, 51*b*) to each other. Accordingly, upon application of a low voltage, the MPU (53*b*) detects connection between the short-circuit lines (51*a*, 51*b*) of the auxiliary circuit (51).

<Indoor Unit (20)>

The indoor unit (20), serving as an electrical system, includes an indoor power supply circuit (22), an indoor unit transmission circuit (21), an indoor control circuit (23), an outdoor memory section (24), a relay (K2R), a first diode (D1), and a second diode (D2). Although not shown, the indoor unit (20) includes an indoor heat exchanger and an indoor fan, for example.

—Indoor Power Supply Circuit (22)—

The indoor power supply circuit (22) includes a noise filter (22*a*), a diode bridge circuit (22*b*), a smoothing capacitor (22*c*), and a switching power supply (22*d*). The indoor power supply circuit (22) converts an AC supplied from the main power supply line (1L) through the power line (L) and the common line (N) to a DC (a DC at 5 V in this example), and supplies the DC to the indoor control circuit (23).

The noise filter (22*a*) includes two coils. The diode bridge circuit (22*b*) performs full-wave rectification on an AC input from the power line (L) and the common line (N) through the noise filter (22*a*). The smoothing capacitor (22*c*) is, for example, an electrolytic capacitor, and smooths an output of the diode bridge circuit (22*b*). The switching power supply (22*d*) is, for example, a DC-to-DC converter, converts the DC smoothed by the smoothing capacitor (22*c*) to a predetermined voltage (5 V), and inputs the predetermined voltage to the indoor control circuit (23).

—Indoor Unit Transmission Circuit (21)—

As described above, the indoor unit transmission circuit (21) performs signal communication with the outdoor unit transmission circuit (11). In this communication, communication is performed based on the potential difference between the signal line (S) and the common line (N). Thus, an end of a communication circuit of the indoor unit transmission circuit (21) is connected to the signal line (S), and the other end of the communication circuit is connected to the common line (N).

—Relay (K2R)—

The relay (K2R) is provided on a bypass line (B) connecting the power line (L) and the signal line (S) to each other, and switches between a connection state in which the power line (L) and the signal line (S) are connected to each other and a disconnection state in which the power line (L) and the signal line (S) are not connected to each other. The relay (K2R) serves as a start-up unit that starts power supply to the outdoor unit (10) to which power supply is shut off. When the relay (K2R) is turned on, the power line (L) and the signal line (S) are connected to each other, whereas when the relay (K2R) is turned off, the power line (L) and the signal line (S) are disconnected from each other. On/off operation of the relay (K2R) is controlled by the indoor control circuit (23).

—First Diode (D1)—

The anode of the first diode (D1) is connected to a connection node (ND1) between the bypass line (B) and the signal line (S), and the cathode of the first diode (D1) is connected to the relay (K2R). The first diode (D1) inhibits an AC flowing into the indoor unit transmission circuit (21).

—Second Diode (D2)—

The anode of the second diode (D2) is connected to the connection node (ND1) of the signal line (S) and the cathode of the second diode (D2) is connected to a signal input node (ND2) in the indoor unit transmission circuit (21). The second diode (D2) inhibits an AC flowing out of the indoor unit transmission circuit (21).

—Indoor Control Circuit (23)—

The indoor control circuit (23) includes a microcomputer and a memory storing a program for operating the microcomputer. In response to an instruction from the remote controller (30), the indoor control circuit (23) controls an operating state of the air conditioner (1). The indoor control circuit (23) serves as a failure detector for detecting a setting error of the forced start-up mechanism (50), which will be described later. The indoor control circuit (23) also serves as a notification unit that notifies the remote controller (30) of the error when detecting a setting error of the forced start-up mechanism (50).

—Indoor Memory Section (24)—

The indoor memory section (24) is connected to the indoor control circuit (23). The indoor unit memory section (24) previously stores device model specification information ("1" or "0" bit) indicating whether the indoor unit (20) is a standby power reduction supporting model or not.

<Remote Controller (30)>

The remote controller (30) accepts operation of a user, and transmits a signal in accordance with the operation of the user to the indoor control circuit (23). The user can perform operations such as operation start, operation stop, and temperature setting of the air conditioner (1) by button operation of the remote controller (30), for example. The remote controller (30) is a wired remote controller including a remote controller memory section (31).

—Remote Controller Memory Section (31)—

The remote controller memory section (31) previously stores device model specification information ("1" or "0" bit) indicating whether the remote controller (30) is a standby power reduction supporting model or not.

<Setting of Forced Start-Up Mechanism>

As illustrated in FIG. 13, in shipment of the air conditioner (1), the connector plug (52*c*) is inserted in the connector body (52*b*). Thus, an installation operator of the air conditioner (1) determines whether the indoor unit (20) is a standby power reduction supporting model or not in installing the air conditioner (1). If the operator determines that the indoor unit (20) is a standby power reduction supporting model, the operator removes the connector plug (52*c*) from the connector body (52*b*). In this example, since the indoor unit (20) is a standby power reduction supporting model, the connector plug (52*c*) is removed from the connector body (52*b*), as illustrated in FIG. 12. Thus, the first short-circuit line (51*a*) is separated from the second short-circuit line (51*b*), and power supply to the auxiliary circuit (51) is shut off.

<Operation of Air Conditioner>

The state transition of the air conditioner (1) is the same as that of the first embodiment illustrated in FIG. 2. The air conditioner (1) transitions among four states: a suspended state, a charging state, a wait state, and an operating state, which will be described later. In the following description, standby power consumption refers to "steady-state power consumption when equipment is not used or waits for some input (e.g., an instruction indication)". Specifically, in the air conditioner (1), power consumption necessary for only waiting for an instruction from the remote controller (30) is standby power consumption.

(1) Suspended State

The suspended state is a state in which electric power is supplied to the indoor unit (20) and no electric power is supplied to the outdoor unit (10). This suspended state is a standby mode of the present invention.

The suspended state of this embodiment is, for example, a state in which power consumption of the whole air conditioner (1) is the minimum. Specifically, in the suspended state of this embodiment, the outdoor unit (10) receives and supplies electric power to the indoor unit (20), but no power is supplied to, for example, circuits and the electric compressor in the outdoor unit (10). That is, in the suspended state, no electric power is supplied to the outdoor control circuit (13) so that operation of the outdoor control circuit (13) is stopped. In this manner, in the suspended state, power supply to the circuits in the outdoor unit (10) is shut off, thereby reducing standby power consumption.

On the other hand, standby power consumption of the indoor unit (20) is the minimum, and unlike the outdoor unit (10), part of the indoor control circuit (23) responsible for signal reception from the remote controller (30) receives electric power from the indoor power supply circuit (22) and operates.

Standby power consumption of the remote controller (30) is also the minimum, and the remote controller (30) can accept button operation by a user. The degrees of power consumption (standby power consumption) of the indoor unit (20) and the remote controller (30) are not limited to those described herein.

(2) Charging State

For the outdoor unit (10), the charging state refers to a state from formation of a path for charging the smoothing capacitor (12*b*) of the second outdoor power supply circuit (12) to start of signal transmission between the outdoor unit transmission circuit (11) and the indoor unit transmission circuit (21). Power consumption of the indoor unit (20) in the charging state is similar to that in the suspended state.

(3) Wait State

The wait state refers to a state after the charging state when operation is started, and a state transitioned from an operating state (which will be described later) when operation is stopped. In both cases, the outdoor unit (10) is ready for, i.e., can promptly transition to, the operating state. In the wait state, the outdoor unit transmission circuit (11) and the outdoor control circuit (13) can also operate. In particular, the wait state in an operation stop period (i.e., the wait state transitioned from the operating state) is provided in order to uniformize the refrigerant pressure in the electric compressor and to be used for scheduled operation in which an operation start and an operation stop are repeatedly performed. The wait state is 10 minutes, for example. Power consumption of the indoor unit (20) is similar to that in the suspended state.

(4) Operating State

The operating state refers to a state in which the main relays (14*b*) are on and the electric compressor and the outdoor fan are operable or in operation. This state also refers to a so-called phase interruption and a thermo-off state. In the indoor unit (20), the indoor fan, for example, becomes an operating state, and power consumption is larger than those in the above-described states. The suspended state, the charging state, the wait state, except the operating state, correspond to "in an operation stop period" of the description.

—Operation Start—

To start operation, the air conditioner (1) transitions from the suspended state to the operating state in the order indicated by the continuous-line arrows in FIG. 13.

<Electrical System in Suspended State>

First, a state of the electrical system in the suspended state will be described with reference to FIG. 11.

In the outdoor unit (10), the main relays (14*b*) are off, no electric power is supplied to the first outdoor power supply circuit (14), and no electric power is supplied from the first outdoor power supply circuit (14) to the IPM and the fan motor.

The relay (K14R) and the relay (K15R) are also off. Thus, the outdoor unit transmission circuit (11) is disconnected from the signal line (S), and power supply is also stopped.

In the relay (K13R), the normally closed contact point and the movable contact are connected to each other, and one of inputs of the diode bridge circuit (12*a*) of the second outdoor power supply circuit (12) is connected to the signal line (S). In this state, no electric power is supplied to any of the second outdoor power supply circuit (12) and the outdoor control circuit (13). In this manner, in the suspended state, power supply to the outdoor unit (10) is shut off.

On the other hand, in the indoor unit (20), the relay (K2R) is off, and the signal line (S) is not electrically connected to the power line (L).

<Transition from Suspended State to Charging State>

Figure 14:
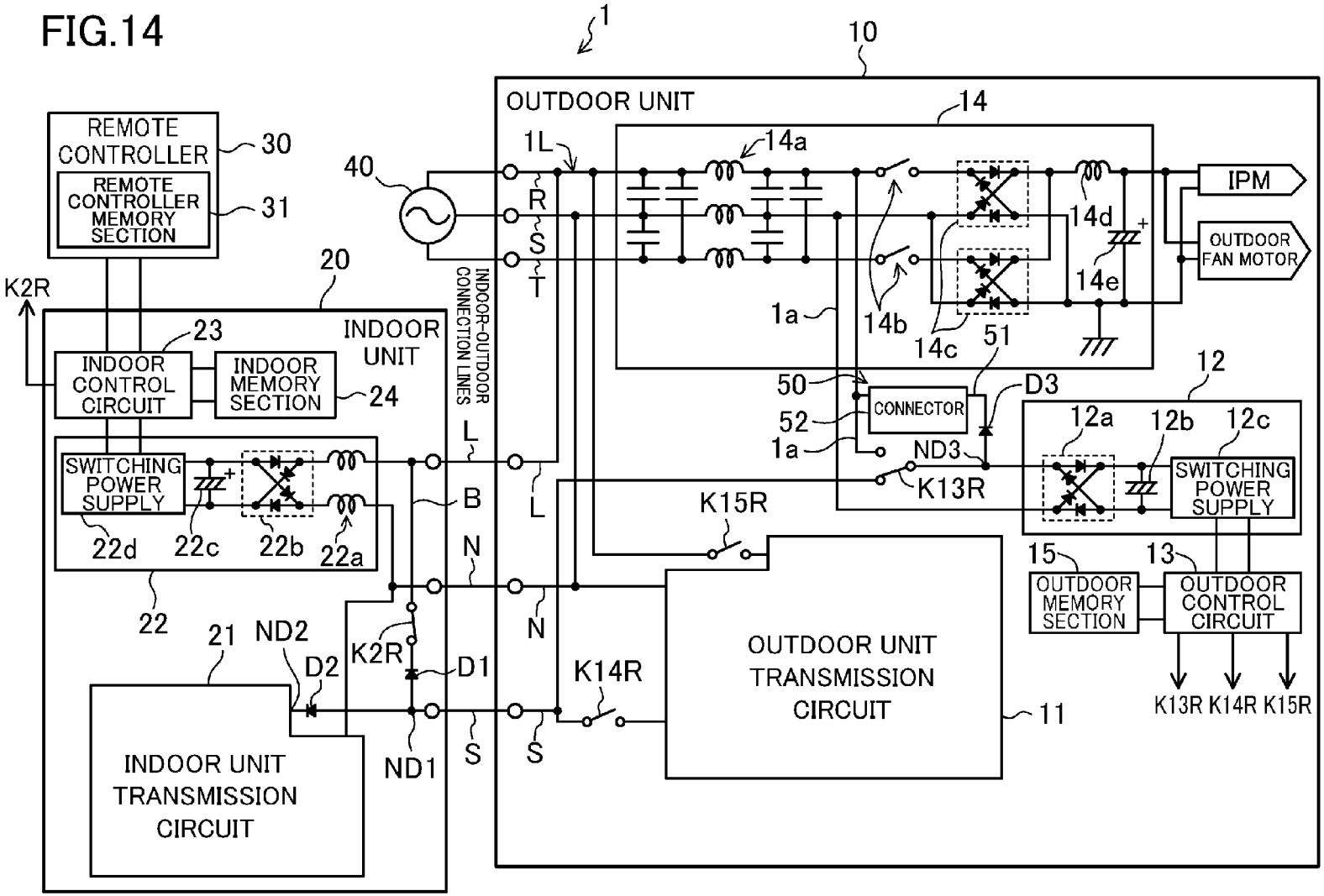
FIG. 14 illustrates states of relays when a circuit for charging a smoothing capacitor is formed.
Figure 15:
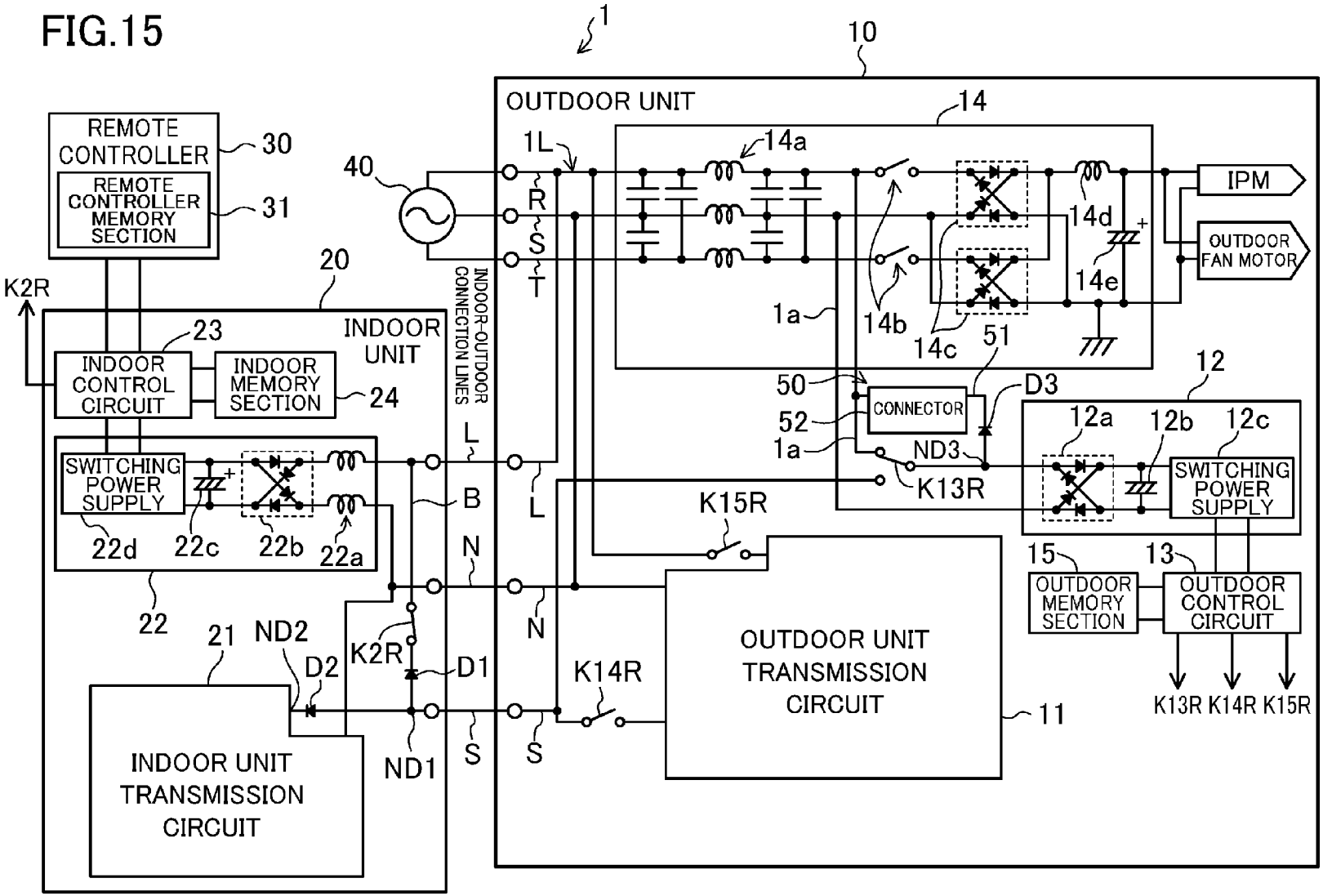
FIG. 15 illustrates states of the relays after completion of transition to a charging state.

FIG. 14 illustrates states of the relays when a circuit for charging the smoothing capacitor (12*b*) is formed. FIG. 15 illustrates states of the relays after transition to the charging state has been completed.

For example, when the user instructs an operation start with the remote controller (30), the remote controller (30) sends an operation instruction signal to the indoor unit (20).

In response to the operation instruction signal, the indoor control circuit (23) of the indoor unit (20) turns the relay (K2R) on. Then, in the air conditioner (1), a power transmission path from the R-phase of the three-phase AC to one of the inputs of the diode bridge circuit (12*a*) through the power line (L), the relay (K2R), the first diode (D1), the signal line (S), and the relay (K13R) is formed. The other input of the diode bridge circuit (12*a*) is connected to the S-phase the three-phase AC, and thus, a single-phase AC subjected to half-wave rectification in the first diode (D1) is supplied to the diode bridge circuit (12*a*). In this manner, a circuit for charging the smoothing capacitor (12*b*) is formed (see FIG. 14).

On the other hand, in the outdoor unit (10), once the smoothing capacitor (12*b*) is charged so that an input to the switching power supply (12*c*) is stabilized and the switching power supply (12*c*) is allowed to output a specific DC voltage (5 V in this example), the outdoor control circuit (13) is started. The outdoor control circuit (13) then causes current to flow in the coil of the relay (K13R), and connects the normally opened contact point to the movable contact. In this manner, one of the inputs of the diode bridge circuit (12*a*) is connected to the R-phase of the three-phase AC through the power supply wiring (1*a*) of the outdoor unit (10). That is, the outdoor control circuit (13) switches to a state in which power is supplied from the AC power supply (40) not passing through the signal line (S) (see FIG. 15). Then, transition from the suspended state to the charging state is completed.

<Transition from Charging State to Wait State>

Figure 16:
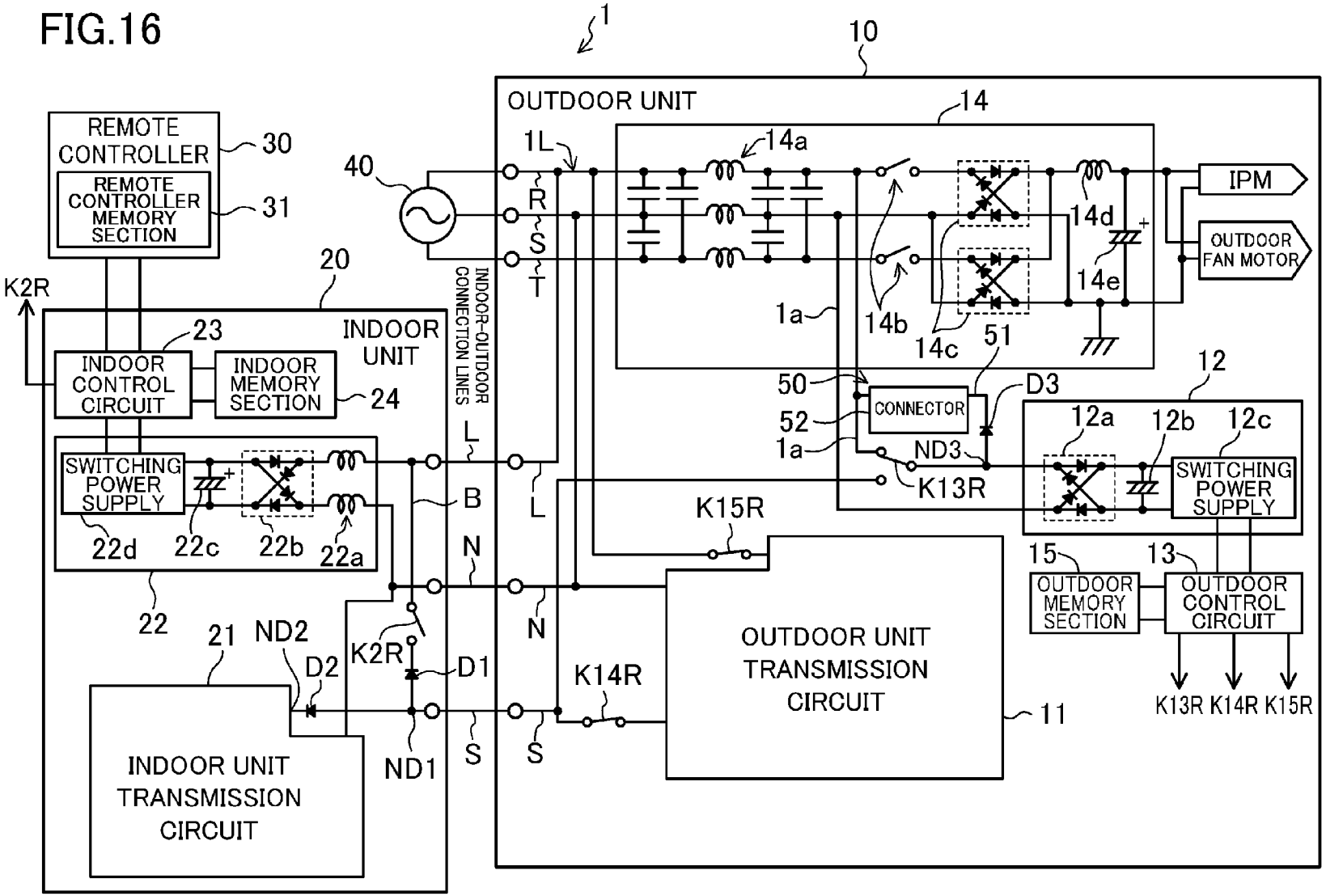
FIG. 16 illustrates states of the relays in a wait state.

FIG. 16 illustrates states of the relays when transition to the wait state is completed. In the indoor unit (20), after a lapse of a predetermined time (a time sufficient for start of the outdoor control circuit (13)) from turning on of the relay (K2R), the relay (K2R) is turned off. In this manner, the signal line (S) can be used for signal transmission.

In the outdoor unit (10), after the relay (K2R) has been turned off, the outdoor control circuit (13) turns the relay (K15R) on so that electric power is supplied to the outdoor unit transmission circuit (11), and the outdoor control circuit (13) turns the relay (K14R) on. In this manner, the communication circuit in the outdoor unit transmission circuit (11) is connected to the indoor unit transmission circuit (21) through the signal line (S) and the common line (N), and is allowed to communicate with the indoor unit transmission circuit (21). Thus, the air conditioner (1) transitions to the wait state, in which the air conditioner (1) is ready for transition to the operating state immediately through the charging state.

<Transition from Wait State to Operating State>

Figure 17:
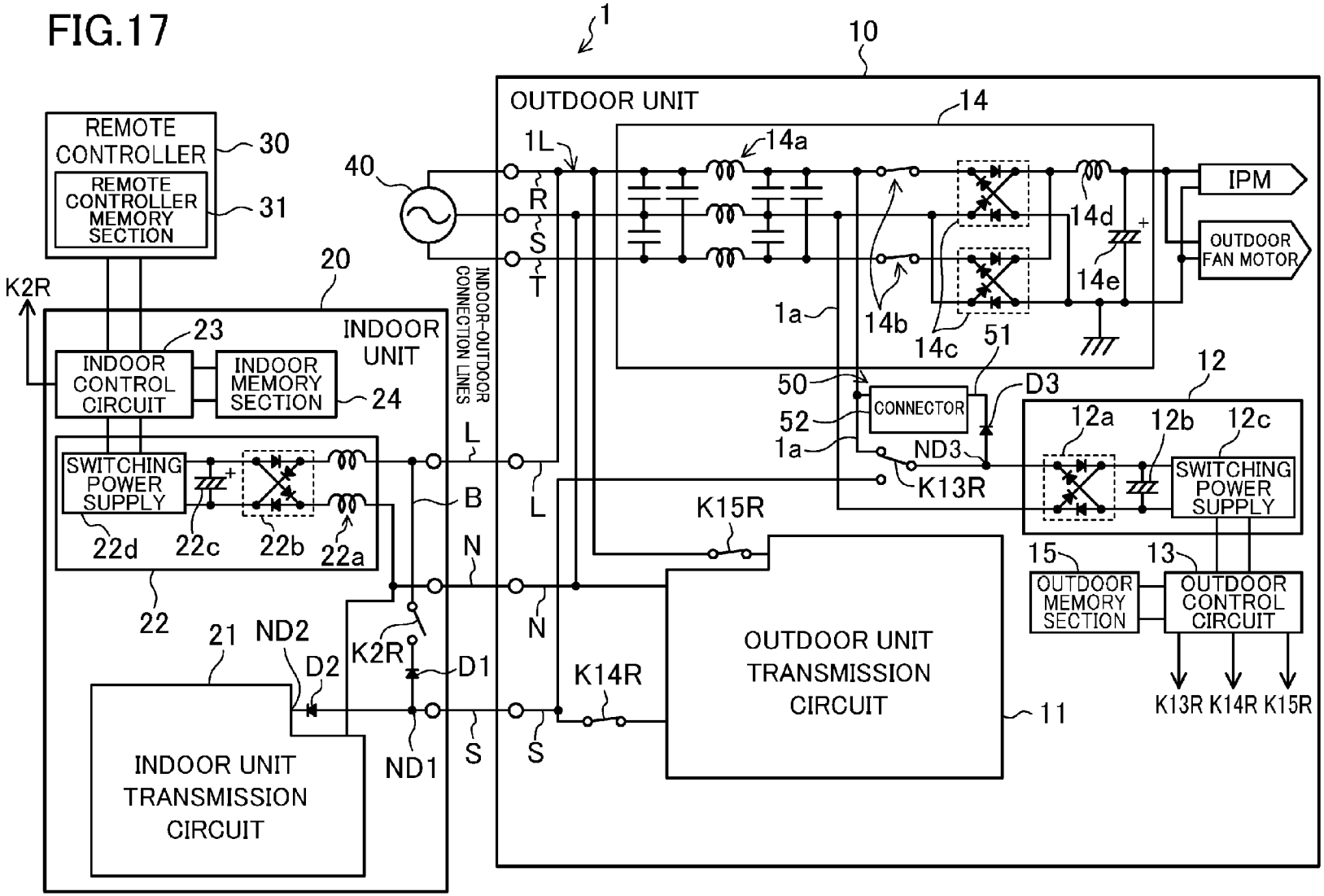
FIG. 17 illustrates states of the relays in an operating state.

FIG. 17 illustrates states of the relays in the operating state. In transition from the wait state to the operating state, the outdoor control circuit (13) turns the two main relays (14*b*) on. Then, the first outdoor power supply circuit (14) supplies electric power to the IPM and the outdoor fan motor, and the electric compressor, for example, comes to be in the operating state. In this manner, the air conditioner (1) performs cooling operation or heating operation with the outdoor unit (10) and the indoor unit (20) communicating with each other.

—Operation Stop—

To stop operation, the air conditioner (1) transitions from the operating state to the suspended state in the order indicated by the broken-line arrows in FIG. 2.

In the operating state, when a user instructs an operation stop with the remote controller (30), the air conditioner (1) transitions to the operating state, the wait state, and the suspended state in this order. Operation from the operating state to the suspended state will now be described in order.

<Transition from Operating State to Wait State>

When the user instructs an operation stop with the remote controller (30), the remote controller (30) transmits an operation stop signal to the indoor unit (20), and the indoor unit (20) transmits the operation stop signal to the outdoor unit (10).

In the outdoor unit (10), in response to the operation stop signal, the outdoor control circuit (13) switches the main relay (K14*b*) from on to off. Thus, the power supply to the IPM and the outdoor fan motor is shut off, and the electric compressor and other components are stopped. In this manner, transition from the operating state to the wait state is completed (see FIG. 16).

<Transition from Wait State to Suspended State>

When the user instructs an operation stop with the remote controller (30), the remote controller (30) refers to a predetermined condition for inhibiting transition to the suspended state. The condition for inhibiting transition to the suspended state is, for example, to inhibit transition from the wait state to the suspended state if the time when the user instructs an operation stop with the remote controller (30) is within a range of a predetermined time from a scheduled operation start time scheduled by a scheduling function. If this condition is not satisfied, the remote controller (30) transmits a shutoff request signal to the indoor unit (20), and the indoor unit (20) transmits the shutoff request signal to the outdoor unit (10).

In the outdoor unit (10), in response to the shutoff request signal, the outdoor control circuit (13) turns the relay (K14R) and the relay (K15R) off. In this manner, the outdoor unit transmission circuit (11) is disconnected from the indoor unit transmission circuit (21), and the outdoor unit (10) and the indoor unit (20) cannot communicate with each other any more. The indoor control circuit (13) switches the relay (K13R) from a state in which the normally opened contact point is connected to the movable contact to a state in which the normally closed contact point is connected to the movable contact. In this manner, the power supply to the second outdoor power supply circuit (12) is shut off. Immediately before switching of the relay (K13R, K14R, K15R), the outdoor unit (10) transmits a shut-off execution signal to the indoor unit (20). In this manner, transition to the suspended state is completed (see FIG. 11).

—Forced Start-Up Operation—

Figure 18:
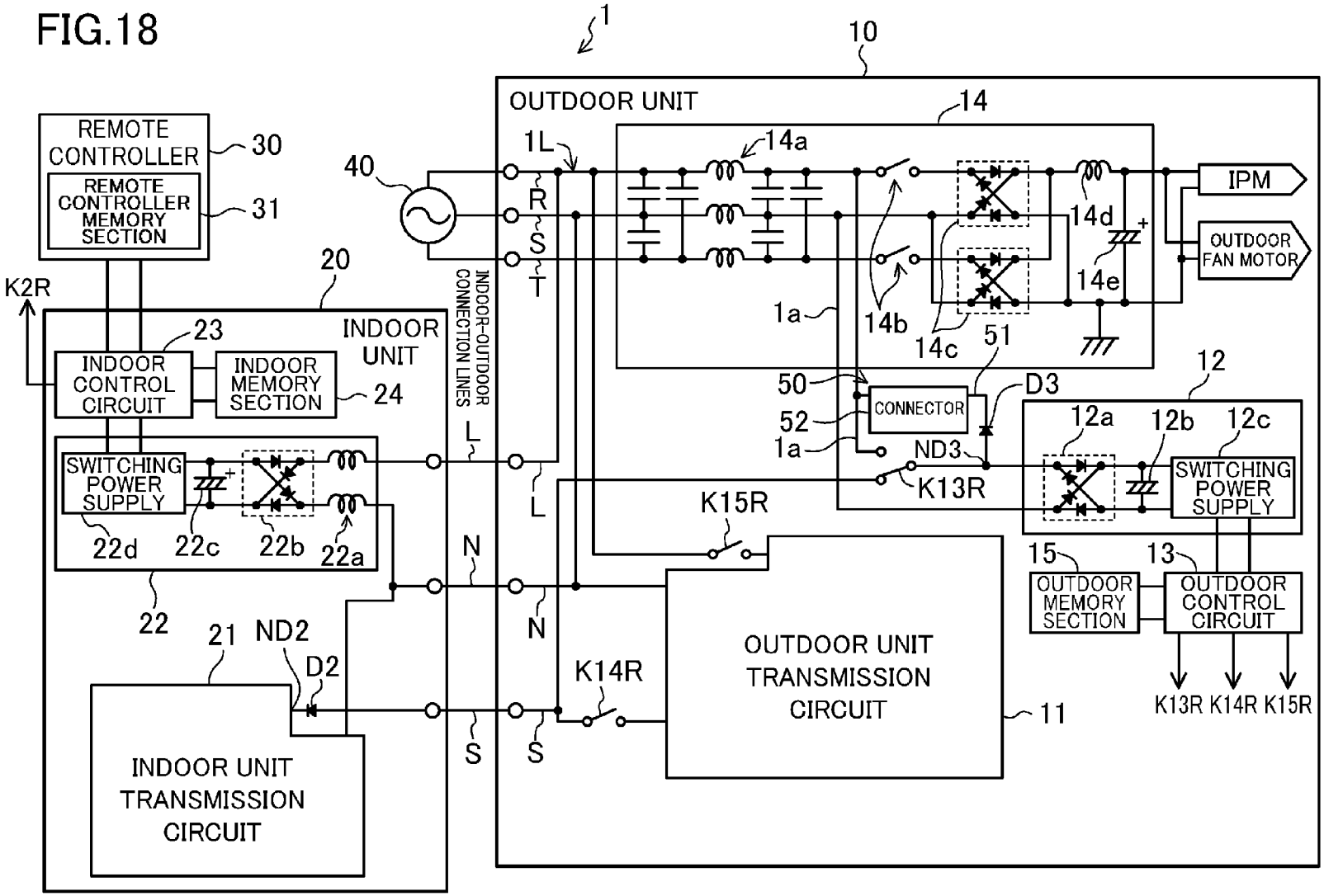
FIG. 18 is an electrical system block diagram of the air conditioner when an outdoor unit, an indoor unit that is a standby power reduction unsupporting model, and a remote controller that is a standby power reduction unsupporting model are connected to one another.

As illustrated in FIG. 18, the air conditioner (1) can use a combination of the outdoor unit (10) and the indoor unit (20) that is a standby power reduction unsupporting model. Unlike a case where the indoor unit (20) is a standby power reduction supporting model, the indoor unit (20) that is a standby power reduction unsupporting model, however, has no relay (K2R), and thus, cannot start the outdoor unit (10) in the suspended state.

Thus, in setting the forced start-up mechanism (50), the installation operator of the air conditioner (1) does not remove the connector plug (52*c*) from the connector body (52*b*), and allows the connector plug (52*c*) to be in the connector body (52*b*), as illustrated in FIG. 13. Then, current flows in the auxiliary circuit (51), and a path extending from the AC power supply (40) to the second outdoor power supply circuit (12) while bypassing the relay (K13R) is formed. Thus, electric power is always supplied from the AC power supply (40) to the outdoor control circuit (13) through the second power supply circuit (12). In this manner, the outdoor unit (10) is started. In this case, the air conditioner (1) does not transition to the suspended state, but transitions to the two states: the wait state and the operating state.

—Detection of Setting Error of Forced Start-Up Mechanism—

As described above, in the air conditioner (1), the forced start-up mechanism (50) is set based on determination of the installation operator in the field. Thus, the installation operator incorrectly sets the forced start-up mechanism (50) in some cases. In using a combination of the outdoor unit (10) and the indoor unit (20) that is a standby power reduction supporting model, if the forced start-up mechanism (50) is incorrectly set, i.e., the operator fails to remove the connector plug (52*c*) from the short-circuit connector (52), no electric power is supplied to the outdoor unit (10) because of the presence of the path from the AC power supply (40) to the second outdoor power supply circuit (12) through the auxiliary circuit (51).

To prevent this, the air conditioner (1) is configured such that the indoor control circuit (23) of the indoor unit (20) that is a standby power reduction supporting model detects a setting error of the forced start-up mechanism (50) at a first start of the air conditioner (1) by connecting the outdoor unit (10), the indoor unit (20), and the remote controller (30) to one another.

Figure 19:
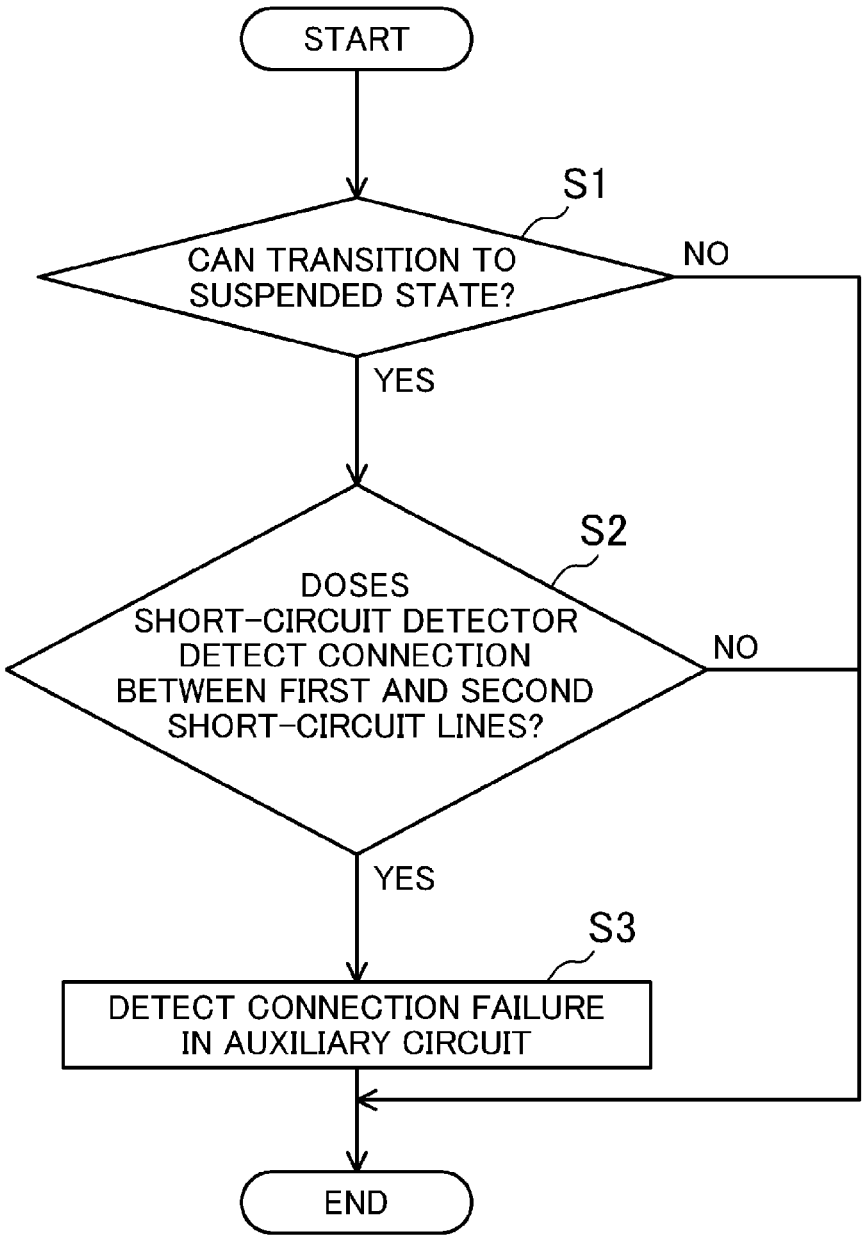
FIG. 19 is a flowchart for detecting a setting error of the forced start-up mechanism.
Figure 20:
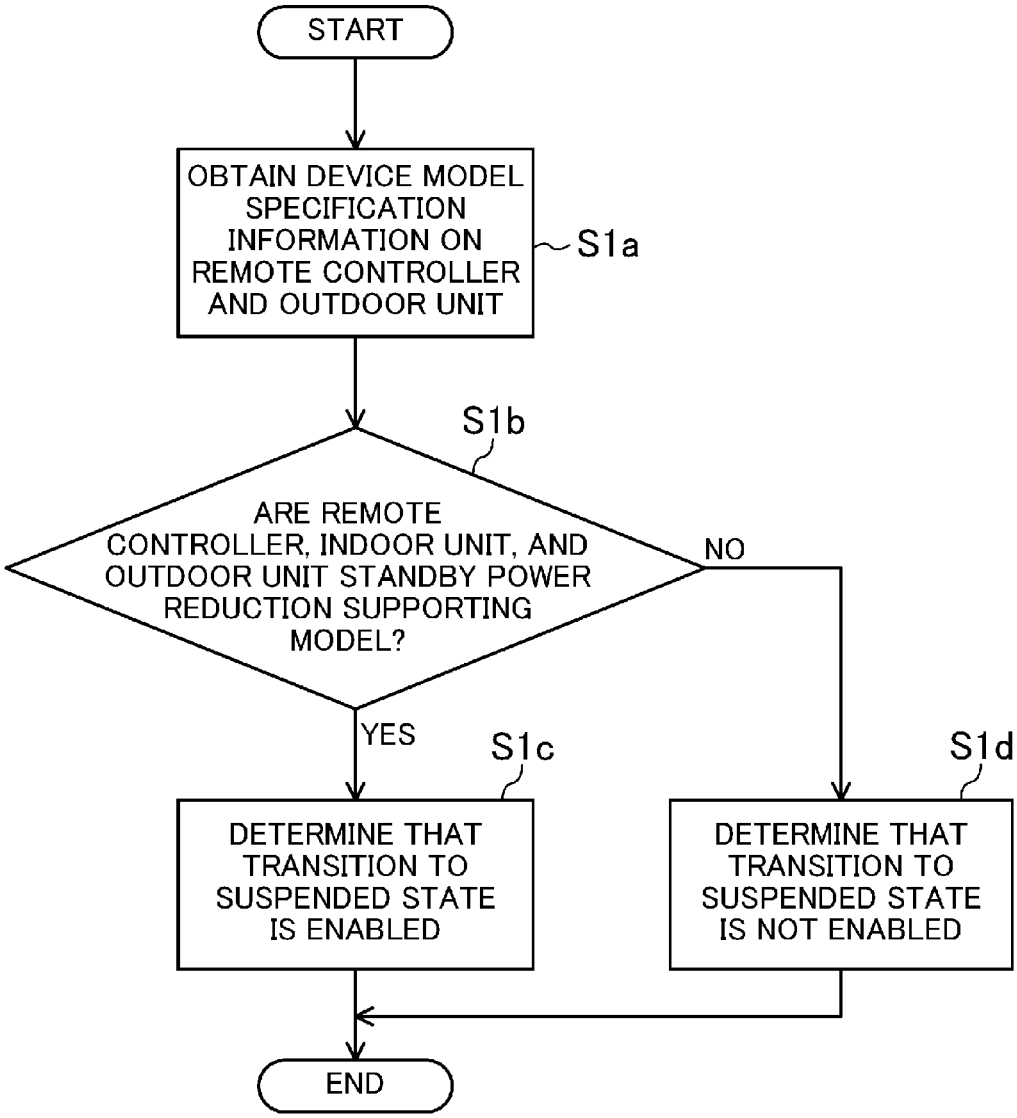
FIG. 20 is a flowchart for determining whether transition to a suspended state can be performed or not.

Specifically, based on the flow shown in FIG. 19, the indoor control circuit (23) detects a setting error of the forced start-up mechanism (50). First, in step S1, the indoor control circuit (23) determines whether the air conditioner (1) can transition to the suspended state or not. The determination on whether the air conditioner (1) can transition to the suspended state or not is carried out based on the flow shown in FIG. 20.

Specifically, in step S1*a*, the indoor control circuit (23) acquires device model specification information on the outdoor unit (10) and the remote controller (30) from the outdoor memory section (15) and the remote controller memory section (31).

Subsequently, in step S1*b*, based on the device model specification information, the indoor control circuit (23) determines whether each of the outdoor unit (10), the indoor unit (20), and the remote controller (30) is a standby power reduction supporting model or not. If all of the outdoor unit (10), the indoor unit (20), and the remote controller (30) are standby power reduction supporting models, the process proceeds to step S1*c*. On the other hand, if at least one of the outdoor unit (10), the indoor unit (20), and the remote controller (30) is not a standby power reduction supporting model, the process proceeds to step S1*d*.

In step S1*c*, it is determined that the air conditioner (1) can transition to the suspended state. On the other hand, in step S1*d*, it is determined that the air conditioner (1) cannot transition to the suspended state.

Referring back to the flowchart of FIG. 19, if it is determined that the air conditioner (1) can transition to the suspended state, the process proceeds to step S2, whereas if it is determined that the air conditioner (1) cannot transition to the suspended state, the process is finished.

In step S2, the short-circuit detector (53) determines whether the first short-circuit line (51*a*) and the second short-circuit line (51*b*) are connected to each other or not. If the short-circuit detector (53) detects connection between the short-circuit lines (51*a*, 51*b*), the process proceeds to step S3. If the short-circuit detector (53) detects disconnection between the short-circuit lines (51*a*, 51*b*), the process is finished.

In step S3, the indoor control circuit (23) detects a connection failure in the auxiliary circuit (51). In this manner, the indoor control circuit (23) detects a setting error of the forced start-up mechanism (50).

Upon detection of the connection failure of the auxiliary circuit (51), the indoor control circuit (23) notifies the remote controller (30) of the connection failure in the auxiliary circuit (51).

<Advantages of Second Embodiment>

In this embodiment, in a situation where the air conditioner (1) can transition to the suspended state, if an installation operator of the air conditioner (1) incorrectly sets the forced start-up mechanism (50), i.e., fails to remove the connector plug (52*c*) from the connector body (52*b*), the indoor control circuit (23) detects a connection failure in the auxiliary circuit (51). Then, the indoor control circuit (23) notifies the remote controller (30) of the connection failure in the auxiliary circuit (51). With this process, the installation operator can find a failure in removing the connector plug (52*c*) of the connector body (52*b*) without fail, and can remove the connector body (52*b*) of the connector plug (52*c*). Thus, it is possible to avoid a failure in shutting off a power supply to the outdoor unit (10) when the user uses the air conditioner (1) that can transition to the suspended state, thereby enhancing the reliability with smooth operation of the air conditioner (1).

In addition, since the short-circuit detector (53) includes the short-circuit connector (52*a*) that connects the first and second short-circuit lines (51*a*, 51*b*) to each other, it is possible to detect connection between the short-circuit lines (51*a*, 51*b*) with a simple configuration with a reduced number of components.

<Variation of Second Embodiment>

Figure 21:
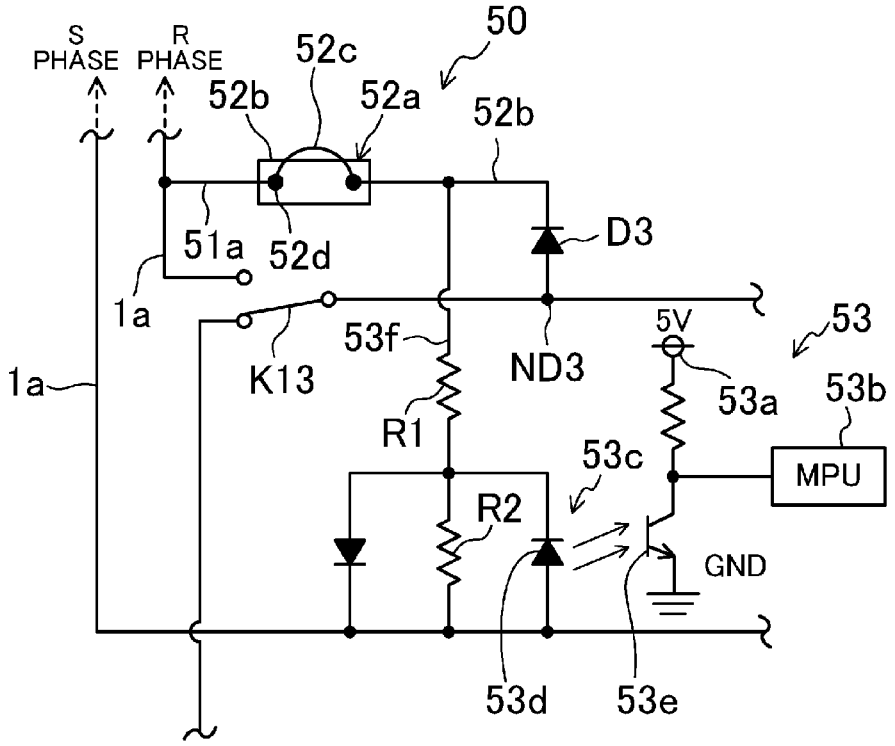
FIG. 21 illustrates a variation of a short-circuit detector of the second embodiment.

As illustrated in FIG. 21, in this variation, the configuration of the short-circuit detector is different from that of the second embodiment. Thus, the following description is mainly directed to the configuration of the short-circuit detector. In FIG. 21, identical or equivalent elements to those described in the second embodiment are denoted by the same reference characters.

The short-circuit connector (52*a*) is configured to connect the first short-circuit line (51*a*) and the second short-circuit line (51*b*) to each other by inserting a two-pin connector plug (52*c*), not a four-pin plug, to the connector body (52*b*).

The short-circuit detector (53) includes ground (GND), an external power supply terminal (53*a*) for receiving an external power supply (5 V in this example), and a microprocessor (53*b*) (hereinafter referred to as an MPU) serving as a detector connected to the external power supply terminal (53*a*) through a resistor.

The second short-circuit line (51*b*) is connected to one end of the detection line (53*f*) whose another end is connected to the power supply wiring (1*a*) of the S-phase of the three-phase AC.

The detection line (53*f*) is connected to the voltage dividing resistor (R1) and the voltage dividing resistor (R2) in series in this order from a side toward the second short-circuit line (51*b*) to a side toward the power supply wiring (1*a*) of the S-phase of the three-phase AC.

A light emitting diode (53*d*) of the photocoupler (53*c*) is connected in parallel with a voltage dividing resistor (R2). Thus, the light emitting diode (53*d*) emits light when the first short-circuit line (51*a*) and the second short-circuit line (51*b*) are connected to each other.

A phototransistor (53*e*) of the photocoupler (53*c*) is connected to between the external power supply terminal (53*a*) and the ground (GND).

In this configuration, when the short-circuit connector (52*a*) disconnects the first short-circuit line (51*a*) from the second short-circuit line (51*b*), the light emitting diode (53*d*) does not emit light, and the phototransistor (53*e*) does not operate. Thus, the ground (GND) is substantially not electrically connected to the external power supply terminal (53*a*). On the other hand, when the short-circuit connector (52*a*) connects the first short-circuit line (51*a*) to the second short-circuit line (51*b*), the light emitting diode (53*d*) emits light, and the phototransistor (53*e*) operates. Thus, the ground (GND) is electrically connected to the external power supply terminal (53*a*). Accordingly, a high voltage is applied to the MPU (53*b*) when the short-circuit connector (52*a*) disconnects the first short-circuit line (51*a*) from the second short-circuit line (51*b*), whereas a low voltage is applied to the MPU (53*b*) when the short-circuit connector (52*a*) connects the first short-circuit line (51*a*) to the second short-circuit line (51*b*). In this manner, upon application of a low voltage, the MPU (53*b*) detects connection between the short-circuit lines (51*a*, 51*b*) of the auxiliary circuit (51).

<Other Variations of Second Embodiment>

The second embodiment may be modified as follows.

In the above description, it is determined that the air conditioner (1) can transition to the suspended state only when all the outdoor unit (10), the indoor unit (20), and the remote controller (30) are standby power reduction supporting models. Alternatively, to detect a setting error of the forced start-up mechanism, the determination does not need to be carried out in this manner. Specifically, in FIG. 20, in a situation where device model specification information on the outdoor unit (10) and the remote controller (30) is not acquired in step S1*a*, in step S1*b*, if the indoor unit (20) is a standby power reduction supporting model, it is determined that the air conditioner (1) can transition to the suspended state, whereas if the indoor unit (20) is a standby power reduction unsupporting model, it is determined that the air conditioner (1) cannot transition to the suspended state.

In the above description, the indoor control circuit (23) detects a setting error of the forced start-up mechanism (50) (a connection failure in the auxiliary circuit (51)). Alternatively, for example, the outdoor control circuit (13) may detect a setting error of the forced start-up mechanism (50).

INDUSTRIAL APPLICABILITY

The present invention is useful for air conditioners.

DESCRIPTION OF REFERENCE CHARACTERS

1 air conditioner
1L main power supply line
1*a* power supply wiring
10 outdoor unit
12 second outdoor power supply circuit
13 outdoor control circuit
16 selection mechanism
16*a* auxiliary circuit
17 opening/closing unit
20 indoor unit
23 indoor control circuit (failure detector, notification unit)
30 remote controller
21 indoor unit transmission circuit
40 commercial AC power supply (AC power supply)
51 auxiliary circuit
51*a* first short-circuit line
51*b* second short-circuit line
52 connection point
52*a* connector
53 short-circuit detector (short-circuit detector)
53*a* external power supply terminal
53*b* microprocessor (detector)
53*c* photocoupler
53*d* light emitting diode
53*e* phototransistor
K2R relay (start-up unit)
K13R relay (switch)
GND ground

The invention claimed is:

1. An air conditioner, comprising:

an outdoor unit and an indoor unit that receive electric power from a main power supply line, the air conditioner being configured to transition to a suspended state in which electric power is supplied to the indoor unit but no electric power is supplied to the outdoor unit and to transition to the suspended state from an operating state in which the air conditioner is operable, the outdoor unit being configured to transition to a a suspended state and to be connectable to an indoor unit that is configured to transition to a suspended state and an indoor unit that is not configured to transition to the suspended state;

an outdoor control circuit provided in the outdoor unit and configured to receive electric power from the main power supply line through a power supply wiring; and a selection mechanism provided on the power supply wiring, and configured to prevent a current flow in the power supply wiring in an operation stop period to determine whether to adapt the outdoor unit to the indoor unit that is configured to transition to the suspended state, and configured to inhibit transition of the outdoor unit to the suspended state in a case where the outdoor unit is not adapted to the indoor unit that is configured to transition to the suspended state.

2. The air conditioner of claim 1, wherein the selection mechanism includes:

a switch provided in the power supply wiring, and configured to prevent a current flow in the power supply wiring in the operation stop period so that the air conditioner transitions to the suspended state in which no electric power is supplied to the outdoor unit;

an auxiliary circuit connected to the power supply wiring, provided in parallel with the switch, and configured to always supply electric power to the outdoor control circuit ; and an opening/closing unit provided in the auxiliary circuit and configured to open and close the auxiliary circuit.

3. The air conditioner of claim 2, wherein the opening/closing unit is a connector that causes current to flow in the auxiliary circuit.

4. The air conditioner of claim 2, wherein the opening/closing unit is a latching relay that causes current to flow in the auxiliary circuit.

5. The air conditioner of claim 1, wherein the selection mechanism is a latching relay provided in the power supply wiring and configured to open and close the power supply wiring and to prevent a current flow in the power supply wiring in the operation stop period so that the air conditioner transitions to the suspended state in which no electric power is supplied to the outdoor unit.

6. An air conditioner capable of employing a combination of an indoor unit and an outdoor unit havin different device model s ecifications the air conditioner comprising:

an outdoor control circuit provided in the outdoor unit and configured to receive electric power from an AC power supply through a power supply wiring;

wherein the selection mechanism includes:

a switch provided in the power supply wiring, and configured to prevent a current flow in the power supply wiring in the operation stop period so that the air conditioner transitions to the standby mode in which no electric power is supplied to the outdoor unit;

an auxiliary circuit including first and second short-circuit lines that are separated from each other, are connected to the power supply wiring, and bypasses the switch;

a connector capable of connecting the first short-circuit line and the second short-circuit line to each other;

a short-circuit detector configured to detect connection between the first short-circuit line and the second short-circuit line; and a failure detector configured to determine whether the air conditioner is configured to be able to transition to the standby mode or not based on at least device model specification information on the indoor unit, and to detect a connection failure in the auxiliary circuit when the short-circuit detector detects connection between the first short-circuit line and the second short-circuit line if it is determined that the air conditioner is configured to be able to transition to the standby mode.

7. The air conditioner of claim 6, wherein the short-circuit detector includes a terminal connected to ground, an external power supply terminal that receives an external power supply, a detector that is connected to the external power supply terminal and detects a supply voltage from the external power supply terminal, and the connector configured to connect the first short-circuit line and the second short-circuit line to each other and to connect the ground and the external power supply terminal to each other.

8. The air conditioner of claim 6, wherein the short-circuit detector includes ground, an external power supply terminal that receives an external power supply, a detector that is connected to the external power supply terminal and detects a supply voltage supplied from the external power supply terminal, a light emitting diode that emits light when the first short-circuit line and the second short-circuit line are connected to each other, and a phototransistor connected between the external power supply terminal and the ground and configured to operate in response to light from the light emitting diode.

9. The air conditioner of claim 6, further comprising:

a remote controller; and a notification unit that notifies the remote controller of a connection failure in the auxiliary circuit when the failure detector detects the connection failure.

10. The air conditioner of claim 7, further comprising:

a remote controller; and a notification unit that notifies the remote controller of a connection failure in the auxiliary circuit when the failure detector detects the connection failure.

11. The air conditioner of claim 8, further comprising:

a remote controller; and a notification unit that notifies the remote controller of a connection failure in the auxiliary circuit when the failure detector detects the connection failure.

* * * * *